US010689838B2

(12) United States Patent
Winter

(10) Patent No.: US 10,689,838 B2
(45) Date of Patent: Jun. 23, 2020

(54) LEDGER

(71) Applicant: Roger Winter, St. John, IN (US)

(72) Inventor: Roger Winter, St. John, IN (US)

( * ) Notice: Subject to any disclaimer, the term of this patent is extended or adjusted under 35 U.S.C. 154(b) by 84 days.

(21) Appl. No.: 15/870,997

(22) Filed: Jan. 14, 2018

(65) Prior Publication Data

US 2019/0218766 A1 Jul. 18, 2019

(51) Int. Cl.

*E04B 1/00* (2006.01)
*E04B 1/26* (2006.01)
*E04F 13/08* (2006.01)

(52) U.S. Cl.

CPC ..... *E04B 1/003* (2013.01); *E04B 1/2604* (2013.01); *E04F 13/0837* (2013.01); *E04F 13/0857* (2013.01)

(58) Field of Classification Search

CPC .... E04B 1/003; E04B 1/2604; E04F 13/0837; E04F 13/0857

See application file for complete search history.

(56) References Cited

U.S. PATENT DOCUMENTS

| | | | | |
|---|---|---|---|---|
| 3,712,005 A | | 1/1973 | Eschbach et al. | |
| D270,766 S | * | 9/1983 | Gray | D25/124 |
| D285,610 S | * | 9/1986 | Slocomb, Jr. | D25/124 |
| 4,858,406 A | * | 8/1989 | Lane | E04D 3/405 52/300 |
| D311,961 S | * | 11/1990 | Westphal | D25/124 |
| D335,713 S | * | 5/1993 | Slocomb | D25/124 |
| D344,600 S | * | 2/1994 | Bancroft | D25/124 |
| D379,534 S | * | 5/1997 | DiGiorgio | D25/124 |
| 5,927,023 A | | 7/1999 | Kittilstad | |
| D423,325 S | | 4/2000 | Liss | |
| 6,378,917 B1 | | 4/2002 | Jones | |
| D477,210 S | | 7/2003 | Callahan et al. | |

(Continued)

FOREIGN PATENT DOCUMENTS

| | | | | |
|---|---|---|---|---|
| DE | 9316247 U1 | * | 1/1994 | E04B 1/003 |
| DE | 19921837 A1 | * | 9/2000 | E04B 1/003 |
| DE | 102004029199 A1 | * | 12/2005 | E04B 1/003 |

OTHER PUBLICATIONS

Simpson Strong-Tie Company Inc., Simpson Strong-Tie Wood Construction Connectors HU/HUC/HSUR/L, Hangers; pp. 279-281, Mar. 8, 2017.

(Continued)

*Primary Examiner* — Babajide A Demuren
(74) *Attorney, Agent, or Firm* — McDonnell Boehnen Hulbert & Berghoff LLP

(57) ABSTRACT

A ledger configured for attaching to a structure, such as a house or building, is described. The ledger comprises first and second walls, a first ledge joining the first and second walls, and a second ledge also joining the first and second walls. The first and second walls and the first and the second ledges define a channel that separates the first and second walls and separates the first and second ledges. The channel is open at both a first side of the ledger, and a second side of the ledger opposite the first side of the ledger. In some implementations, the ledger further includes a third ledge. The first and second ledges join the second wall on a first side of the second wall. The third ledge is disposed on a second side of the second wall opposite the first side of the second wall.

22 Claims, 16 Drawing Sheets

(56) References Cited

U.S. PATENT DOCUMENTS

| | | | | |
|---|---|---|---|---|
| 6,668,502 | B2 | 12/2003 | Béliveau | |
| 6,694,686 | B2 | 2/2004 | Ready et al. | |
| 6,845,590 | B1 | 1/2005 | Mills, Jr. | |
| 8,677,713 | B1 * | 3/2014 | Sheehy | E04C 2/20 52/284 |
| D736,956 | S * | 8/2015 | Chaney | D25/124 |
| 9,151,058 | B1 | 10/2015 | Leathe | |
| 9,194,118 | B2 | 11/2015 | Spyrou | |
| D765,492 | S | 9/2016 | Akers | |
| 9,565,939 | B2 | 2/2017 | Brock et al. | |
| 9,714,670 | B2 | 7/2017 | Header | |
| D809,674 | S | 2/2018 | Singh | |
| D814,056 | S | 3/2018 | Singh | |
| D817,518 | S | 5/2018 | Singh | |
| D825,315 | S | 8/2018 | Inzeo | |
| D834,729 | S | 11/2018 | Lee | |

OTHER PUBLICATIONS

U.S. Appl. No. 29/633,478, inventor Roger Winter, filed Jan. 14, 2018.

* cited by examiner

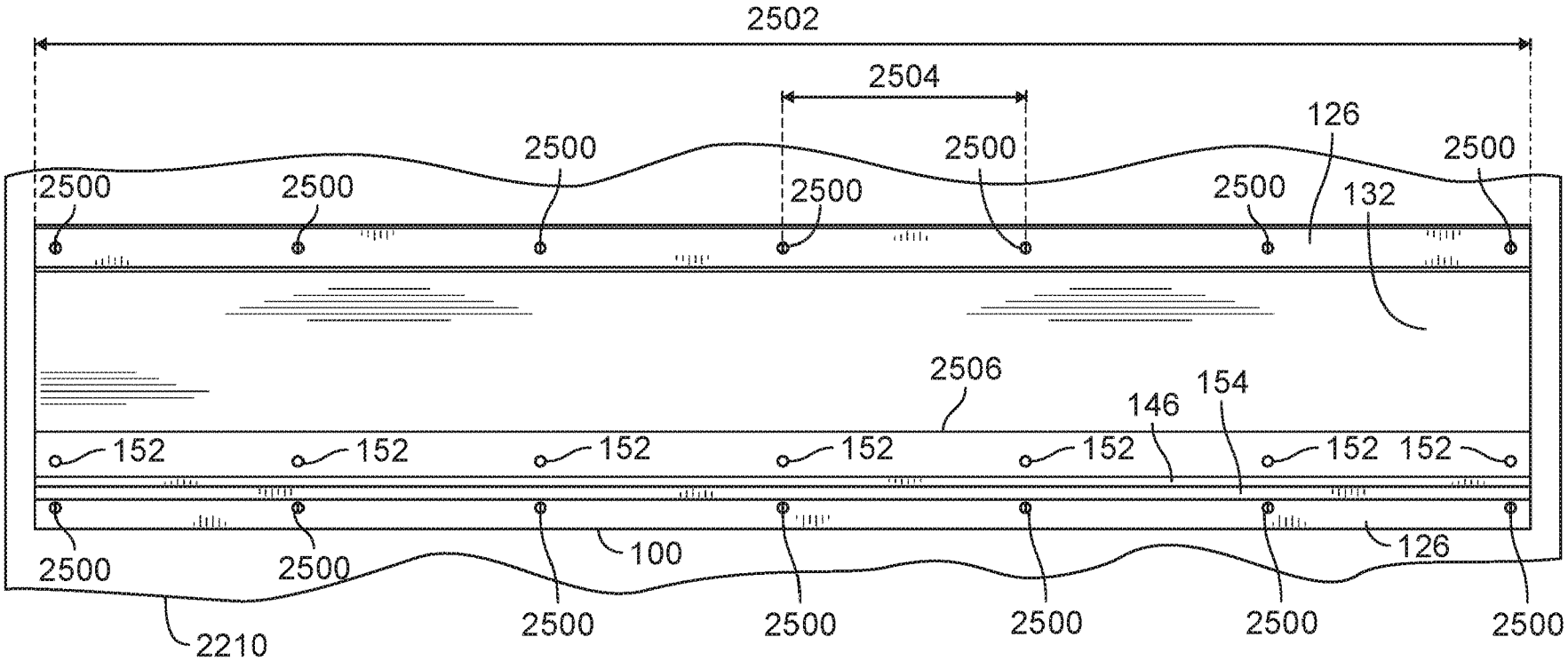
2500
2500
2500

LEDGER

BACKGROUND

A deck is a structure typically built outdoors. A deck can support a load consisting of people, deck furniture, or other items. The supportable load can vary from deck to deck based on such items as the size and type of material used to build the deck. A deck installed in a body of water can be referred to as a pier.

Some decks are free-standing, whereas some other decks are constructed such that the deck is attached to another structure, such as a house. Constructing a deck attached to a house can include attaching a ledger board to a concrete foundation or a rim board of the house. The ledger board can, for example, include a two by eight pressure-treated Spruce, Pine or Fir wooden board. The ledger board typically has a rectangular cross-section such that a top side of the ledger board is flat when attached to the structure. Anchor bolts can be used to attach the ledger board to the rim board or the concrete foundation.

Joist hangers are often attached to the ledger board in order to support first ends of joists. Multiple fasteners, such as screws, bolts, or nails can be used to attach the brackets to the ledger board. Those fasteners can pierce and/or extend through the rim board or the concrete foundation.

Furthermore, in many instances, metal flashing is installed between the ledger board and the rim board. The anchor bolts used to attach the ledger board and the fasteners used to attach the joist hangers to the ledger board typically pierce the metal flashing. As the number of fasteners that pierce the metal flashing, the rim board or the concrete foundation increases, the likelihood for having water leak into the structure increases.

OVERVIEW

In a first implementation, a first example ledger configured for attaching to a structure is provided. The ledger comprises (a) a first wall, (b) a second wall, (c) a first ledge joining the first wall and the second wall, and (d) a second ledge joining the first wall and the second wall. The first wall, the second wall, the first ledge, and the second ledge define a channel that (i) separates the first wall from the second wall, and (ii) separates the first ledge from the second ledge. The channel is open at both a first side of the ledger, and a second side of the ledger opposite the first side of the ledger.

In some implementations of the first example ledger, the first wall can include a front surface, a back surface, and a top surface joining the front surface and the back surface. Moreover, the top surface can be beveled downward from the back surface to the front surface. Additionally or alternatively, the first ledge can be beveled downward from the first wall to the second wall.

In some implementations of the first example ledger, the first wall can include a front surface, a back surface, and a top surface joining the front surface and the back surface, and a portion of the first wall including the top surface can be disposed above both the first ledge and the second ledge. Moreover, the portion of the first wall can include at least one through-hole.

In some implementations of the first example ledger, the first wall can include a front surface, a back surface, and a top surface joining the front surface and the back surface, and the first wall can include (i) a bottom surface opposite the top surface, and (ii) a portion, including the bottom surface, disposed below both the first ledge and the second ledge. Furthermore, the portion disposed below both the first ledge and the second ledge can include at least one through-hole.

In some implementations of the first example ledger, the ledger can include a third ledge. The first ledge and the second ledge can join the second wall on a first side of the second wall. The third ledge can be disposed on a second side of the second wall. The second side of the second wall is opposite the first side of the second wall. In accordance with those implementations, the third ledge can join the second wall.

In some implementations of the first example ledger in which the ledger includes the third ledge, the first ledge and the second ledge can join the second wall on a first side of the second wall. The third ledge can be disposed on a second side of the second wall. The second side of the second wall is opposite the first side of the second wall. Furthermore, the ledger can further include (a) a fourth ledge joining the second wall on the second side of the second wall, and (b) a third wall that joins both the third ledge and the fourth ledge. Furthermore still, the fourth ledge can be below the first ledge, the second ledge, and the third ledge. Moreover, the fourth ledge can include at least one through-hole configured to drain a fluid on a top side of the fourth ledge.

In some implementations of the first example ledger in which the ledger includes the third ledge, the ledger is a first ledger. The third ledge can be configured to support a second ledger. In those implementations, the second wall includes multiple through-holes. Furthermore, the first ledger is configured for fixedly attaching to the second ledger by fasteners placed the multiple through holes and through-holes in the second ledger. Furthermore still, the fasteners do not pass through the first wall. Moreover, multiple shims can be placed between the first ledger and the second ledger.

In some implementations of the first example ledger, the ledger is a single extrusion.

In some implementations of the first example ledger, the ledger is made of aluminum.

In some implementations of the first example ledger, the ledger is made by extruding aluminum through a die.

In some implementations of the first example ledger, the first ledge and the second ledge join the second wall on a first side of the second wall. Also, a second side of the second wall is (i) opposite the first side of the second wall, and (ii) scored, proximate the second ledge, at least partially from the first side of the ledger to the second side of the ledger.

In a second implementation, a second example ledger configured for attaching to a structure is provided. The ledger comprises (a) a first wall, (b) a second wall, (c) a first ledge joining the first wall and the second wall, (d) a second ledge joining the first wall and the second wall, and (e) a third ledge. The first ledge and the second ledge join the second wall on a first side of the second wall. The third ledge joins the second wall on a second side of the second wall. The second side of the second wall is opposite the first side of the second wall. The first wall, the second wall, the first ledge, and the second ledge define a channel that (i) separates the first wall from the second wall, and (ii) separates the first ledge from the second ledge. The channel is open at both a first side of the ledger, and a second side of the ledger opposite the first side of the ledger.

In a third implementation, a third example ledger configured for attaching to a structure is provided. The ledger comprises (a) a first wall, (b) a second wall, (c) a third wall, (d) a first ledge joining the first wall and the second wall, (e) a second ledge joining the first wall and the second wall, (f)

a third ledge, and (g) a fourth ledge joining the second wall. The first ledge and the second ledge join the second wall on a first side of the second wall. The fourth ledge joins the second wall on a second side of the second wall. The third wall joins both the third ledge and the fourth ledge. The second side of the second wall is opposite the first side of the second wall. The fourth ledge is below the first ledge, the second ledge, and the third ledge. The first wall, the second wall, the first ledge, and the second ledge define a channel that (i) separates the first wall from the second wall, and (ii) separates the first ledge from the second ledge. The channel is open at both a first side of the ledger, and a second side of the ledger opposite the first side of the ledger.

Other implementations will become apparent to those of ordinary skill in the art by reading the following detailed description, with reference where appropriate to the accompanying drawings.

BRIEF DESCRIPTION OF THE DRAWINGS

Example embodiments are described herein with reference to the drawings.

FIG. 25 illustrates a ledger attached to a wall of a structure in accordance with example implementations.

DETAILED DESCRIPTION

I. Introduction

This description describes a ledger that is configured for attaching to a structure, such as a house or building. The ledger can be attached to the structure during construction of a deck. Moreover, a variety of components can be attached to the ledger using fasteners. The ledger is configured so that the fasteners used to attach those components do not penetrate a wall of the structure to which the ledger is attached. Limiting the quantity of fasteners that penetrate a wall of the structure is desirable as the likelihood of a fluid such as air or water penetrating the wall is reduced.

A wall is an upright portion of a structure or a ledger. In many instances, a wall is vertical. In other instances, a wall can be substantially vertical. Substantially vertical is within ±forty-five (45) degrees of vertical.

A ledge is a horizontal projection from at least one other portion of a ledger, such as a wall or another ledge. A ledge can be a horizontal or a substantially horizontal projection from at least one other portion of a ledger. Substantially horizontal is within ±forty-five (45) degrees of horizontal.

An anchor hole is a through-hole in a wall of a ledger through which a fastener, such as an anchor bolt or a lag screw can be disposed. The fastener can attach the ledger to a wall of a structure.

A weep hole is a though-hole through which a fluid, such as water, can pass through.

The shade lines shown in the figures are contour lines that form no part of the structure on which the contour lines are shown. The drawings show various sides of the example ledgers. Any "side" of a ledger described in this description can be referred to as and "end." For instance, a right side of a ledger can be referred to as a right end of a ledger.

II. Ledger Implementations

Figure 1:
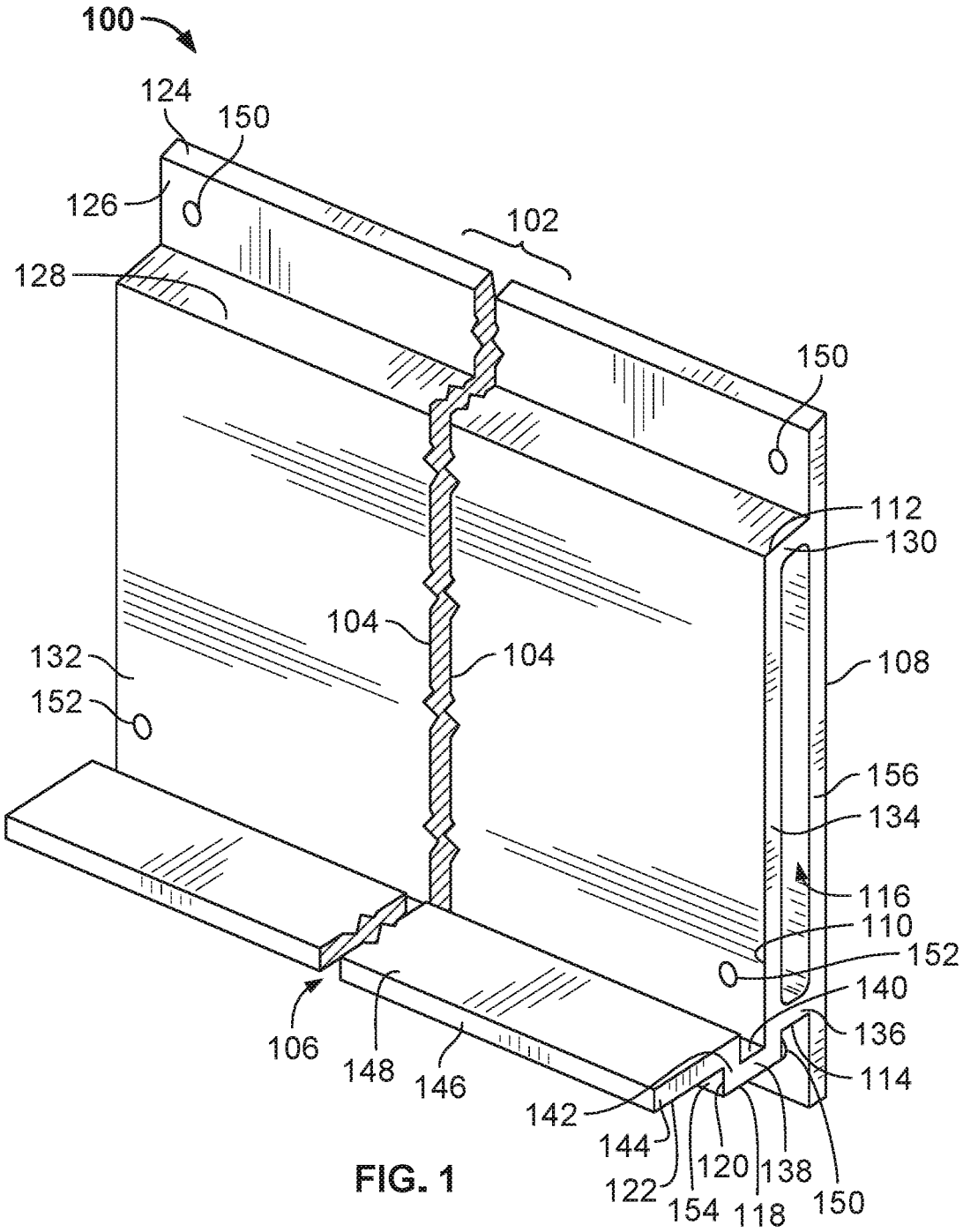
FIG. 1 is a perspective view of a ledger in accordance with example implementations.
Figure 2:
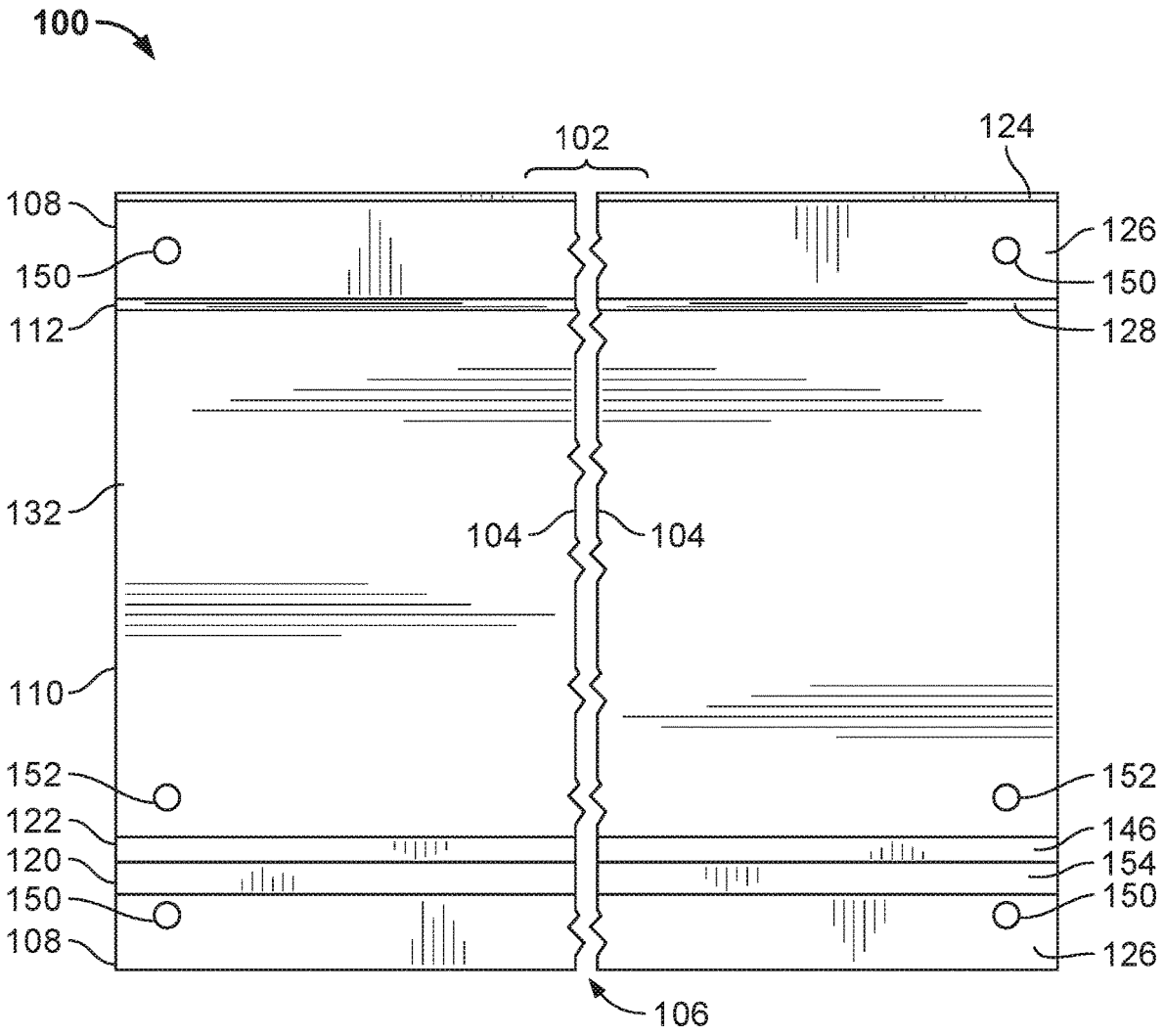
FIG. 2 shows a front side of the ledger shown in FIG. 1.
Figure 3:
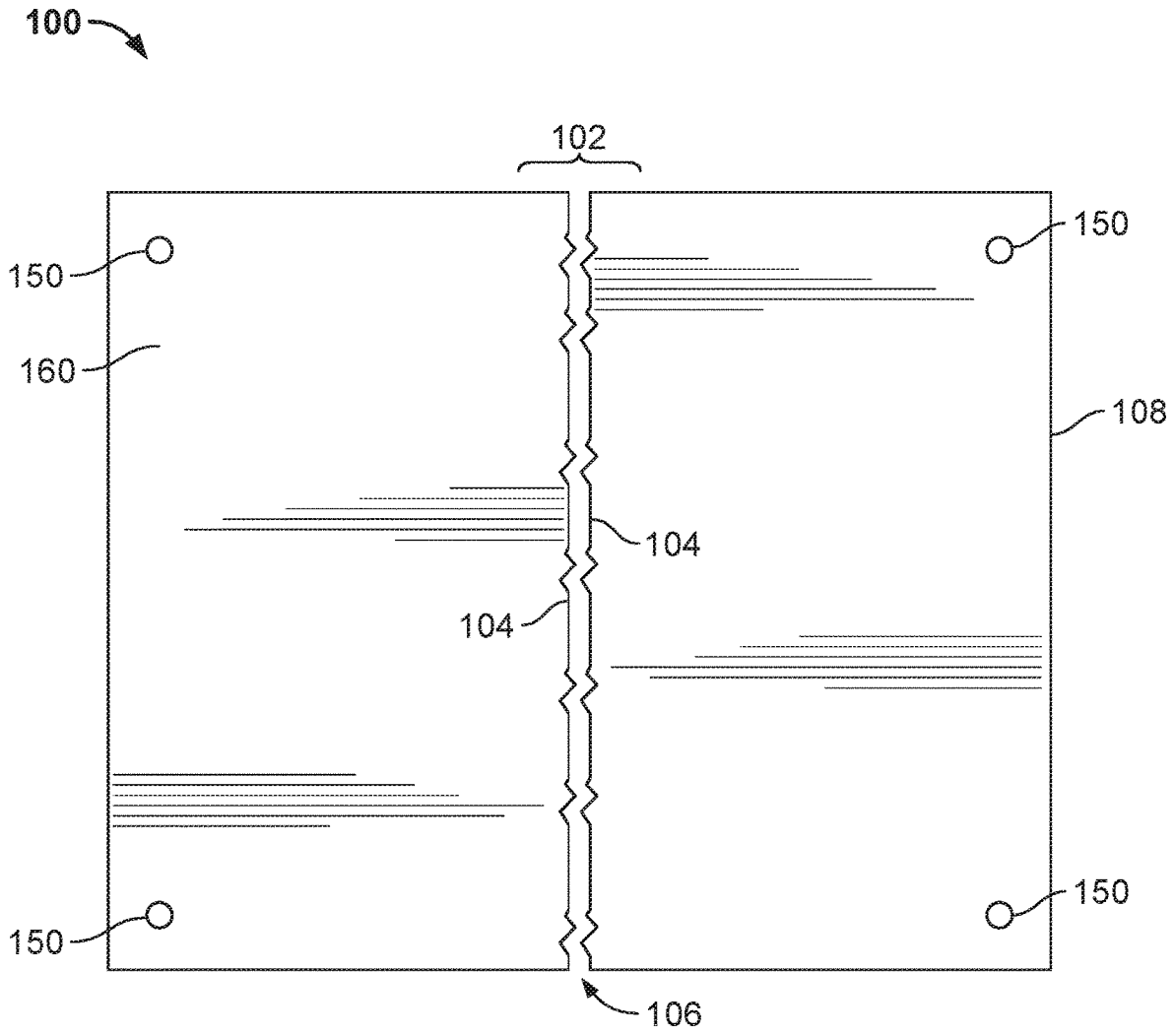
FIG. 3 shows a back side of the ledger shown in FIG. 1.
Figure 4:
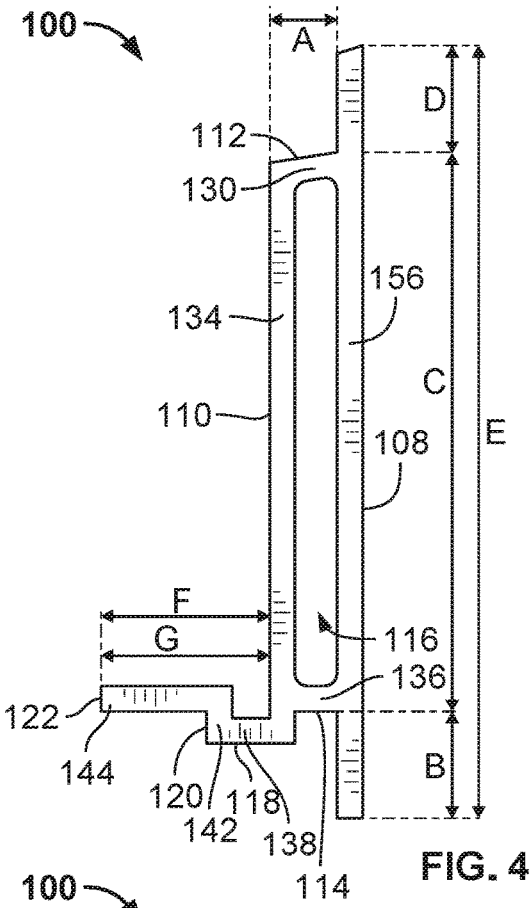
FIG. 4 shows a right side of the ledger shown in FIG. 1.
Figure 5:
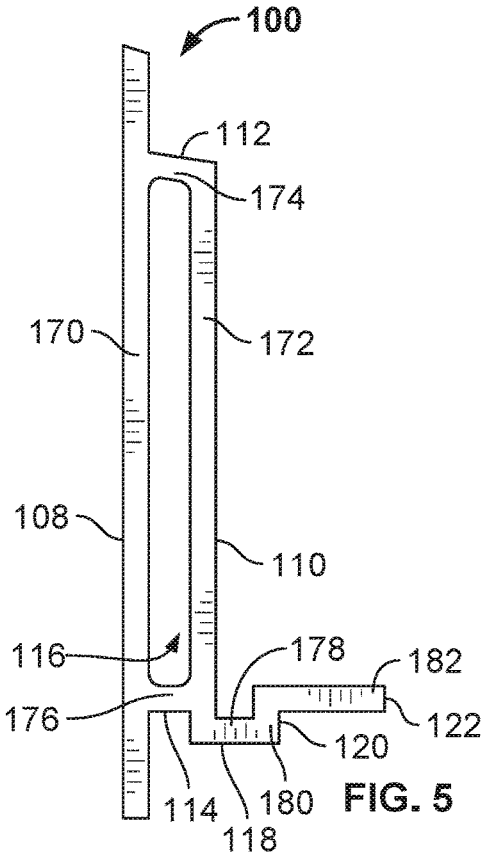
FIG. 5 shows a left side of the ledger shown in FIG. 1.
Figure 6:
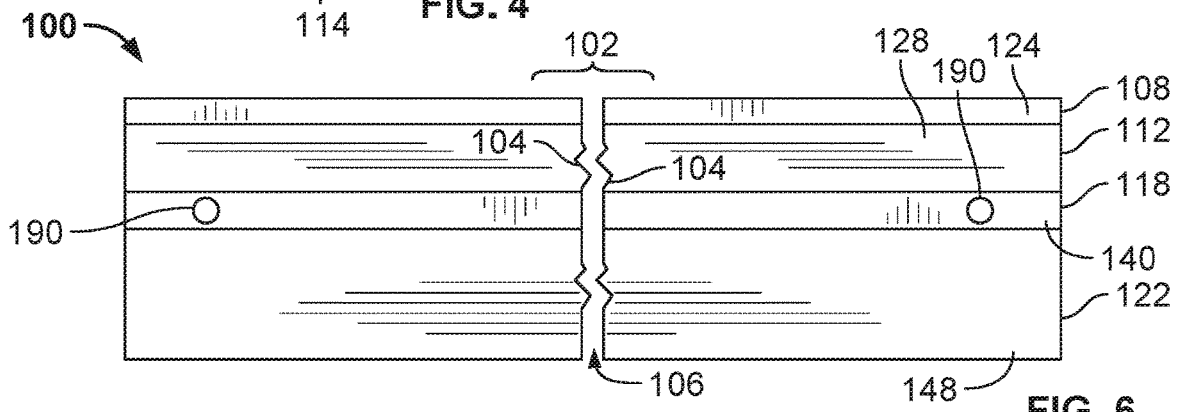
FIG. 6 shows a top side of the ledger shown in FIG. 1.
Figure 7:
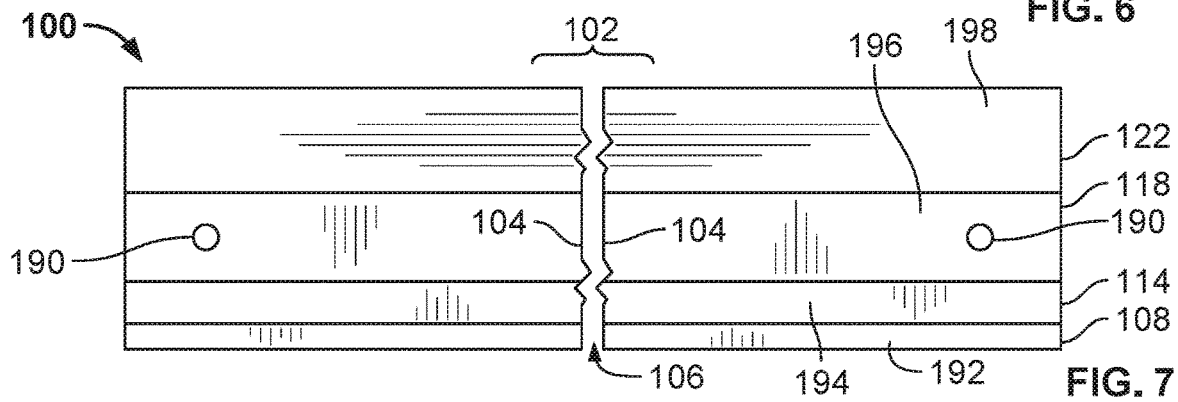
FIG. 7 shows a bottom side of the ledger shown in FIG. 1.

FIG. 1 is a perspective view of a ledger 100 in accordance with example implementations. For this description, this perspective view is said to show a top side of the ledger 100, a portion of a front side of the ledger 100, and a right side of the ledger 100. Although not shown in FIG. 1, the ledger 100 has (a) a bottom side opposite the top side, (b) a back side opposite the front side, and (c) a left side opposite the right side. FIG. 2 shows the front side of the ledger 100. FIG. 3 shows the back side of the ledger 100. FIG. 4 shows the right side of the ledger 100. FIG. 5 shows the left side of the ledger 100. FIG. 6 shows the top side of the ledger 100. FIG. 7 shows the bottom side of the ledger 100.

Any ledger described in this description, such as the ledger 100, can be made by forcing a material through a die. The material can be pushed or pulled through the die. In other words, the ledger can be formed by extruding or drawing the material through the die. Accordingly, the ledger can be referred to as an extruded ledger or a drawn ledger. An extruded ledger can be referred to as an extrusion. As an example, the material can be aluminum. The extrusion can be a single extrusion. The single extrusion can be cut into multiple extrusions. For instance, the single extrusion can be twenty feet long and can be cut into (a) two ten foot long extrusions, or (b) a twelve foot long extrusion and an eight foot long extrusion. Other example dimensions of a single extrusion, multiple extrusions, or the number of extrusions made from a single extrusion are also possible.

FIG. 1 to FIG. 3, FIG. 6, and FIG. 7 show a bracket 102, jagged lines 104, and a gap 106 to represent that the ledger 100 has an indeterminate length. In some implementations, the ledger 100 can be made with a length of eight feet, twelve feet, sixteen feet, or twenty feet. In other implementations, the ledger 100 can have a different length.

The ledger 100 includes walls 108, 110, 120 and ledges 112, 114, 118, 122. The ledge 112 joins the walls 108, 110. Likewise, the ledge 114 also joins the walls 108, 110. The walls 108, 110 and the ledges 112, 114 form a channel 116. The channel 116 separates the wall 108 from the wall 110. The channel 116 also separates the ledge 112 from the ledge 114. In example implementations, the channel 116 extends from the right side of the ledger 100 to the left side of the ledger 100. In the ledgers discussed in this description, portions of a channel in the ledger, such as the portions of a channel at the left and right sides of the ledger, can be plugged or otherwise covered so that items, such as insects or debris, cannot enter into the channel.

In the ledgers described in this description, a wall and a ledge can join one another such that at least a first portion of the wall and at least a first portion of the ledge are the same portion of the ledger and at least a second portion of the wall and a second portion of ledge are different portions of the ledger. For example a first portion of the ledge 112 that joins a first portion of the wall 110 are the same portion of the ledger 100, and a second portion of the ledge 112 and a second portion of the wall 110 are different portions of the ledger 100. As another example, a first portion of ledge 122 that joins a first portion of the wall 120 are the same portion of the ledger 100, and a second portion of the ledge 122 and a second portion of the wall 120 are different portions of the ledger 100.

FIG. 1 shows that (a) the wall 108 includes a top surface 124, a front surface 126, and a right side surface 156, (b) the ledge 112 includes a top surface 128 and a right side surface 130, (c) the wall 110 includes a front surface 132 and a right side surface 134, (d) the ledge 114 includes a right side surface 136, (e) the ledge 118 includes a top surface 140 and a right side surface 138, (f) the wall 120 includes a right side surface 142, and a front surface 154, and (g) the ledge 122 includes a right side surface 144, a front surface 146, and a top surface 148. FIG. 1 shows anchor holes 150 in the wall 108 and weep holes 152 in the wall 110.

Next, in addition to showing the front side of the ledger 100, FIG. 2 shows the wall 110, the front surface 132, portions of the wall 108, portions of the front surface 126, the ledge 112, the top surfaces 124, 128, the anchor holes 150, and the weep holes 152. In the implementation shown in FIG. 2, the top surfaces 124, 128 are beveled so that water on the top surface 124, 128 flows in a direction from the back side of the ledger 100 towards the front side of the ledger 100. In the implementations in which the ledger 100 is attached to a wall of a structure, the beveled top surfaces 124, 128 keep water on the top surfaces from flowing towards the wall of the structure. As an example, the top surface 124 can be beveled such that top surface 124 at the front side of the wall 108 is 0.125 inches lower than the top surface 124 at the back side of the wall 108. Likewise, the top surface 128 can be beveled downward by 0.125 inches. The top surfaces 124, 128 can, but need not necessarily, be beveled by the same distance or slope.

Next, in addition to showing the back side of the ledger 100, FIG. 3 shows the wall 108, a back surface 160 of the wall 108, and the anchor holes 150.

Next, in addition to showing the right side of the ledger 100, FIG. 4 shows the walls 108, 110, 120, the ledges 112, 114, 118, 122, the channel 116, and the right side surfaces 130, 134, 136, 138, 142, 144, 156. A right side surface of the ledger 100 comprises the right side surfaces 130, 134, 136, 138, 142, 144, 156. Furthermore, FIG. 4 shows dimensions A, B, C, D, E, F, G. Table 1 includes example measurements of those dimensions. The quote mark symbols in Table 1 and throughout the description in proximity to a number represent that the dimensions are listed in inches.

TABLE 1

| Example Implementations | A | B | C | D | E | F | G |
|---|---|---|---|---|---|---|---|
| 1 | 0.875" | 1.0" | 5.25" | 1.0" | 7.25" | 1.5" | 1.25" |
| 2 | 0.875" | 1.0" | 7.25" | 1.0" | 9.25" | 1.5" | 1.25" |
| 3 | 0.875" | 1.0" | 9.25" | 1.0" | 11.25" | 1.5" | 1.25" |
| 4 | 3.625" | 1.0" | 5.25" | 1.0" | 7.25" | 1.5" | 1.25" |
| 5 | 3.625" | 1.0" | 7.25" | 1.0" | 9.25" | 1.5" | 1.25" |
| 6 | 3.625" | 1.0" | 9.25" | 1.0" | 11.25" | 1.5" | 1.25" |

The example implementations 1 to 3 can be used for structures in which the ledger 100 is attached in proximity to wall sheathing. The example implementations 4 to 6 can be used for structures in which the ledger 100 is attached in proximity to bricks having a depth of 3.625 inches. Furthermore, in some implementations of the example ledgers, at least some of the walls and/or ledges can have a thickness between 0.00625" and 0.25." For instance, some walls and/or ledges of an example ledger can have a thickness of 0.1875". Other examples of the dimensions of the walls and/or ledges are also possible.

Next, in addition to showing the left side of the ledger 100, FIG. 5 shows the walls 108, 110, 120, the ledges 112, 114, 118, 122, the channel 116, a left side surface 170 of the wall 108, a left side surface 172 of the wall 110, a left side surface 174 of the ledge 112, a left side surface 176 of the ledge 114, a left side surface 178 of the ledge 118, a left side surface 180 of the wall 120, and a left side surface 182 of the ledge 122. A left side surface of the ledger 100 comprises the left side surfaces 170, 172, 174, 176, 178, 180, 182.

Next, in addition to showing the top side of the ledger 100, FIG. 6 shows the wall 108, the ledges 112, 118, 122, the top surfaces 124, 128, 140, 148, and weep holes 190 in the ledge 118.

Next, in addition to showing the bottom side of the ledger 100, FIG. 7 shows the walls 108, the ledges 114, 118, 122, a bottom surface 192 of the wall 108, a bottom surface 194 of the ledge 114, a bottom surface 196 of the ledge 118, a bottom surface 198 of the ledge 122, and the weep holes 190.

The ledger 100 can have a fixed cross-sectional profile prior to any machining of the ledger 100. The machining can, for example, include drilling or punching holes, such as the anchor holes 150, the weep holes 152, and/or the weep holes 190. Any ledger described in this description can include multiple rows of anchor holes. For instance, as shown in FIG. 2, the ledger 100 includes (i) an upper row of ledger holes in proximity to the top surface 124, and (ii) a lower row of anchor holes below the ledge 122. In some implementations of ledgers having multiple rows of anchor holes, the anchor holes in at least two rows of anchor holes can be squarely aligned. A center line passing through two squarely aligned anchor holes is a vertical center line. In some implementations of ledgers having multiple rows of anchor holes, the anchor holes closest to each other in two different rows of anchor holes can be staggered. A center line passing through two staggered anchor holes is not a vertical center line.

Figure 8:
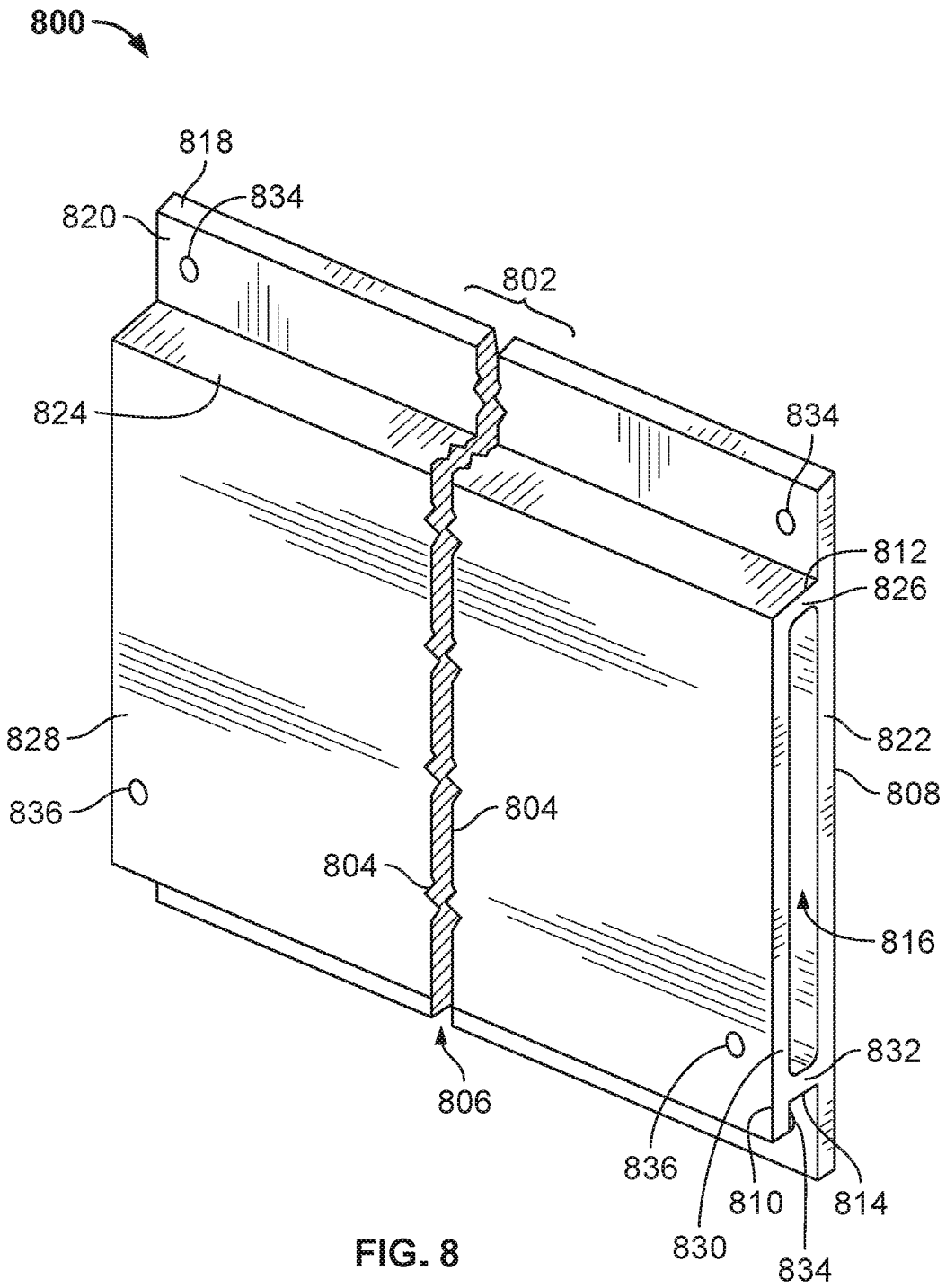
FIG. 8 is a perspective view of a ledger in accordance with example implementations.
Figure 9:
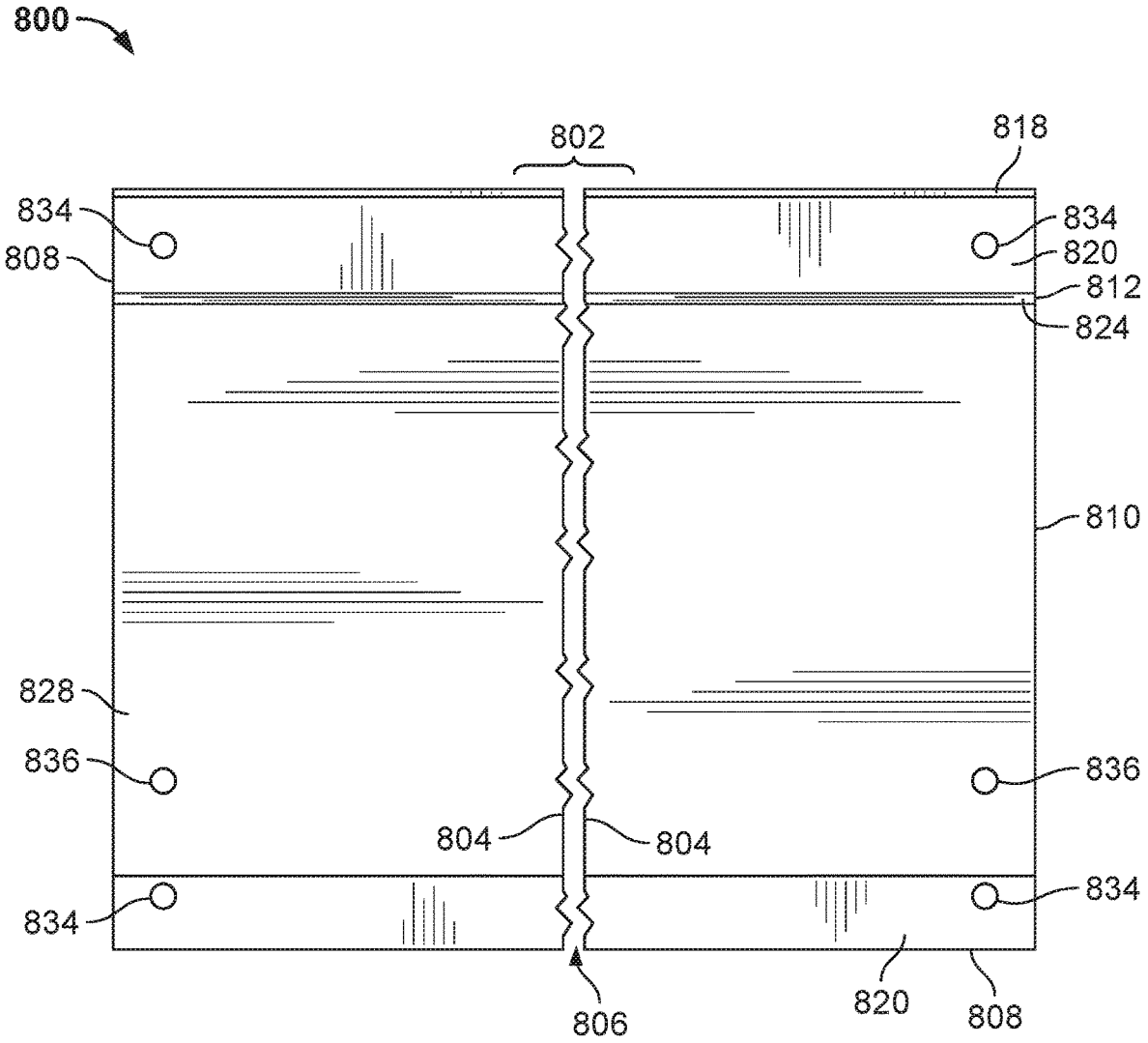
FIG. 9 shows a front side of the ledger shown in FIG. 8.
Figure 10:
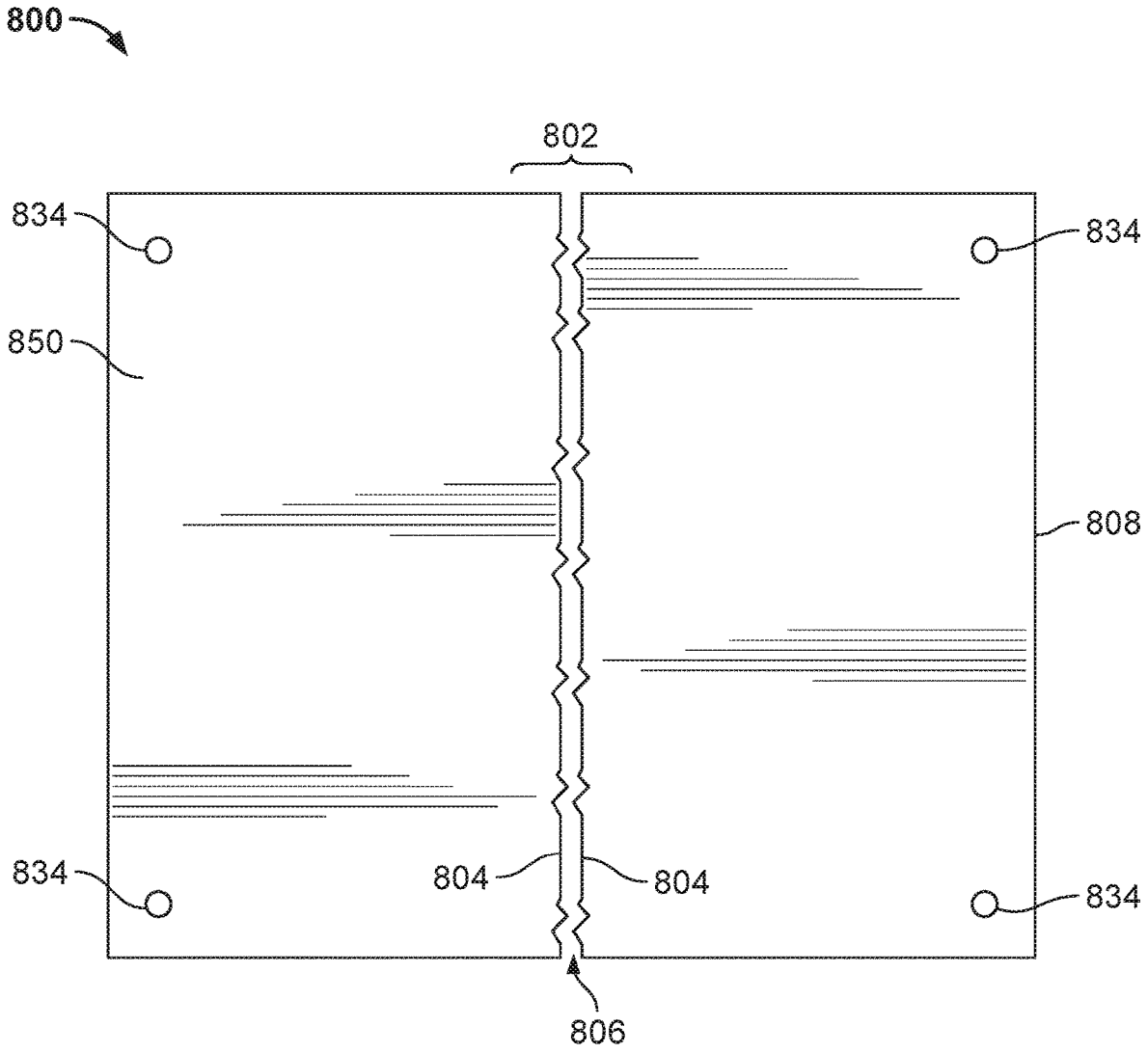
FIG. 10 shows a back side of the ledger shown in FIG. 8.
Figure 11:
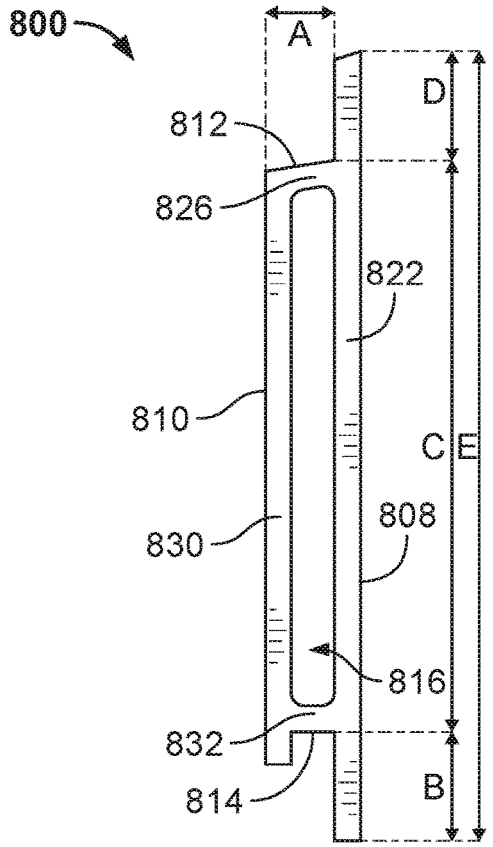
FIG. 11 shows a right side of the ledger shown in FIG. 8.
Figure 12:
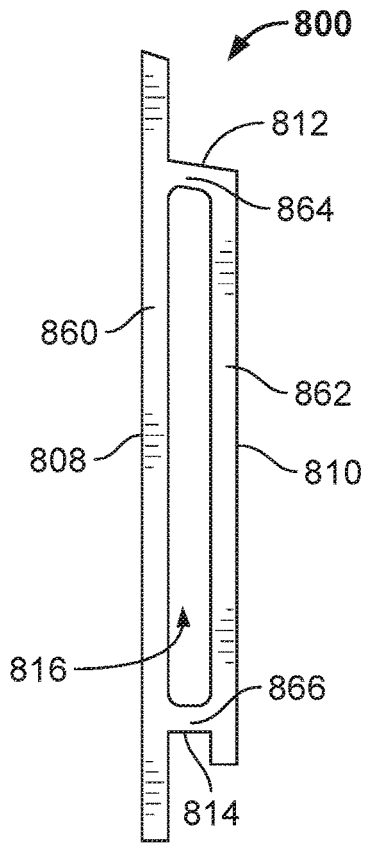
FIG. 12 shows a left side of the ledger shown in FIG. 8.
Figure 13:
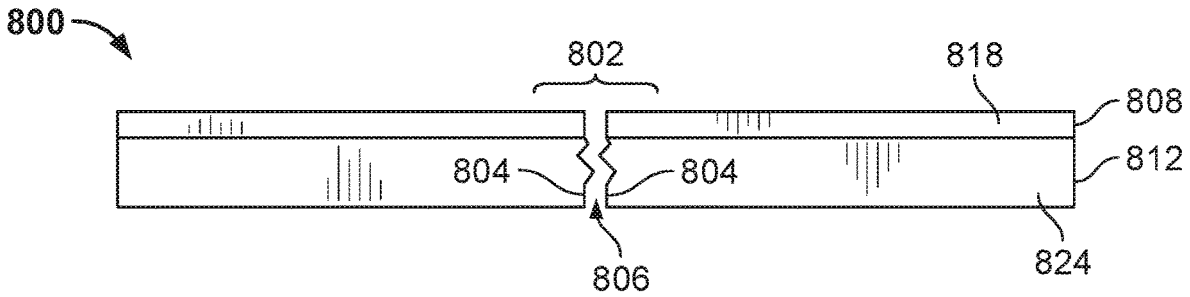
FIG. 13 shows a top side of the ledger shown in FIG. 8.
Figure 14:
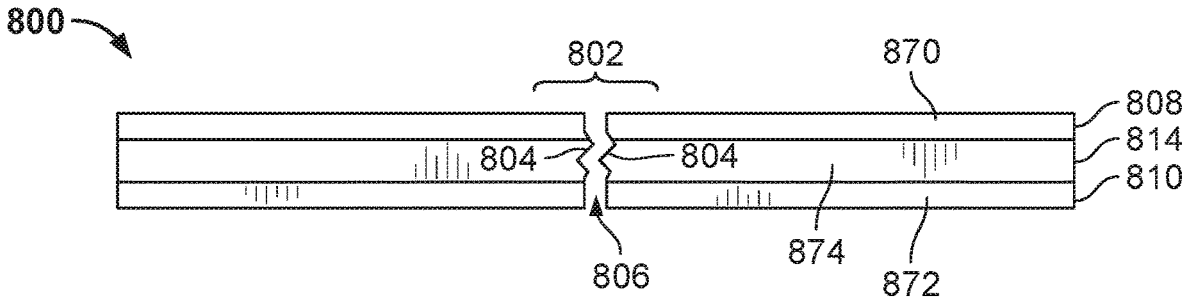
FIG. 14 shows a bottom side of the ledger shown in FIG. 8.

Next, FIG. 8 is a perspective view of a ledger 800 in accordance with additional example implementations. For this description, this perspective view is said to show a top side of the ledger 800, a portion of a front side of the ledger 800, and a right side of the ledger 800. Although not shown in FIG. 8, the ledger 800 has (a) a bottom side opposite the top side, (b) a back side opposite the front side, and (c) a left side opposite the right side. FIG. 9 shows the front side of the ledger 800. FIG. 10 shows the back side of the ledger 800. FIG. 11 shows the right side of the ledger 800. FIG. 12 shows the left side of the ledger 800. FIG. 13 shows the top side of the ledger 800. FIG. 14 shows the bottom side of the ledger 800.

FIG. 8 to FIG. 10, FIG. 12, and FIG. 14 show a bracket 802, jagged lines 804, and a gap 806 to represent that the ledger 800 has an indeterminate length. In some implementations, the ledger 800 can be made with a length of eight feet, twelve feet, sixteen feet, or twenty feet. In other implementations, the ledger 800 can have a different length.

The ledger 800 includes walls 808, 810 and ledges 812, 814. The ledge 812 joins the walls 808, 810. Likewise, the ledge 814 also joins the walls 808, 810. The walls 808, 810 and ledges 812, 814 form a channel 816. The channel 816 separates the walls 808, 810. The channel 816 also separates the ledges 812, 814. In example implementations, the channel 816 extends from the right side of the ledger 800 to the left side of the ledger 800.

FIG. 8 shows that (a) the wall 808 includes a top surface 818, a front surface 820, and a right side surface 822, (b) the ledge 812 includes a top surface 824 and a right side surface 826, (c) the wall 810 includes a front surface 828 and a right side surface 830, and (d) the ledge 814 includes a right side surface 832. FIG. 8 shows anchor holes 834 in the wall 808 and weep holes 836 in the wall 810.

Next, in addition to showing the front side of the ledger 800, FIG. 9 shows the wall 810, the front surface 828, portions of the wall 808, portions of the front surface 820, the ledge 812, the top surfaces 818, 824, the anchor holes 834, and the weep holes 836. In the implementation shown in FIG. 9, the top surfaces 818, 824 are beveled so that water on the top surface 818, 824 flows in a direction from the back side of the ledger 800 towards the front side of the ledger 800. In the implementations in which the ledger 800 is attached to a wall of a structure, the beveled top surfaces 818, 824 keep water on the top surfaces from flowing towards the wall of the structure. As an example, the top surface 818 can be beveled such that top surface 818 at the front side of the wall 808 is 0.125 inches lower than the top surface 818 at the back side of the wall 808. Likewise, the top surface 824 can be beveled downward by 0.125 inches. The top surfaces 818, 824 can, but need not necessarily, be beveled by the same distance or slope.

Next, in addition to showing the back side of the ledger 800, FIG. 10 shows the wall 808, a back surface 850 of the wall 808, and the anchor holes 834.

Next, in addition to showing the right side of the ledger 800, FIG. 11 shows the walls 808, 810, the ledges 812, 814, the channel 816, and the right side surfaces 822, 826, 830, 832. A right side surface of the ledger 800 comprises the right side surfaces 822, 826, 830, 832. Furthermore, FIG. 11 shows dimensions A, B, C, D, and E. Those dimensions can have lengths as described for dimensions A, B, C, D, and E, respectively, shown in FIG. 4. In some implementations, the walls 808, 810 and the ledges 812, 814 can be 0.125 inches thick, and the channel 816 can have the same width as the channel 116.

Next, in addition to showing the left side of the ledger 800, FIG. 12 shows the walls 808, 810, the ledges 812, 814, the channel 816, a left side surface 860 of the wall 808, a left side surface 862 of the wall 810, a left side surface 864 of the ledge 812, and a left side surface 866 of the ledge 814. A left side surface of the ledger 800 comprises the left side surfaces 860, 862, 864, 866.

Next, in addition to showing the top side of the ledger 800, FIG. 13 shows the wall 808, the ledge 812, and the top surfaces 818, 824.

Next, in addition to showing the bottom side of the ledger 800, FIG. 14 shows the walls 808, 810, the ledge 814, a bottom surface 870 of the wall 808, a bottom surface 872 of the wall 810, and a bottom surface 874 of the ledge 814.

The ledger 800 can have a fixed cross-sectional profile prior to any machining of the ledger 800. The machining can, for example, include drilling or punching holes, such as the anchor holes 83 and/or the weep holes 836.

Figure 15:
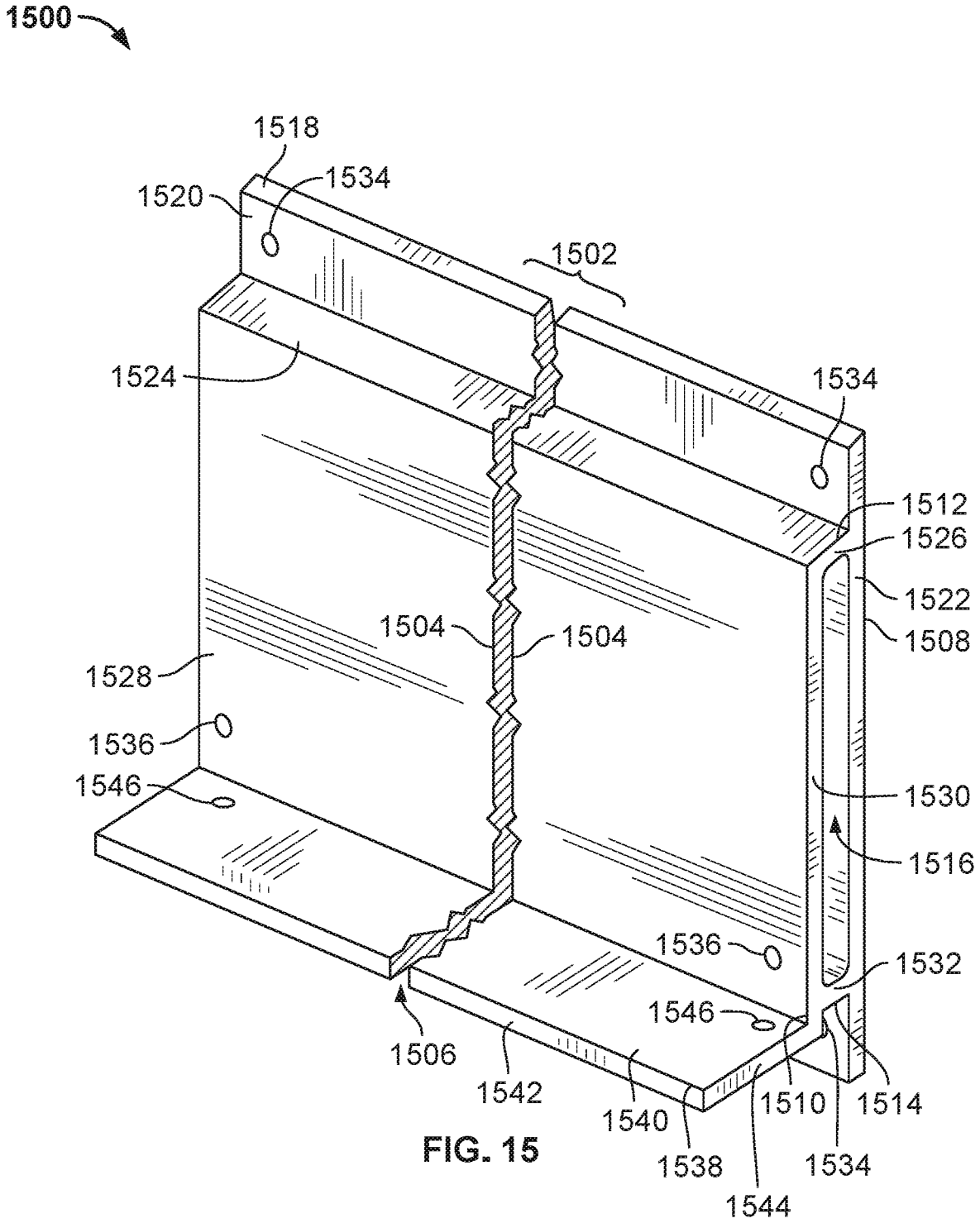
FIG. 15 is a perspective view of a ledger in accordance with example implementations.
Figure 16:
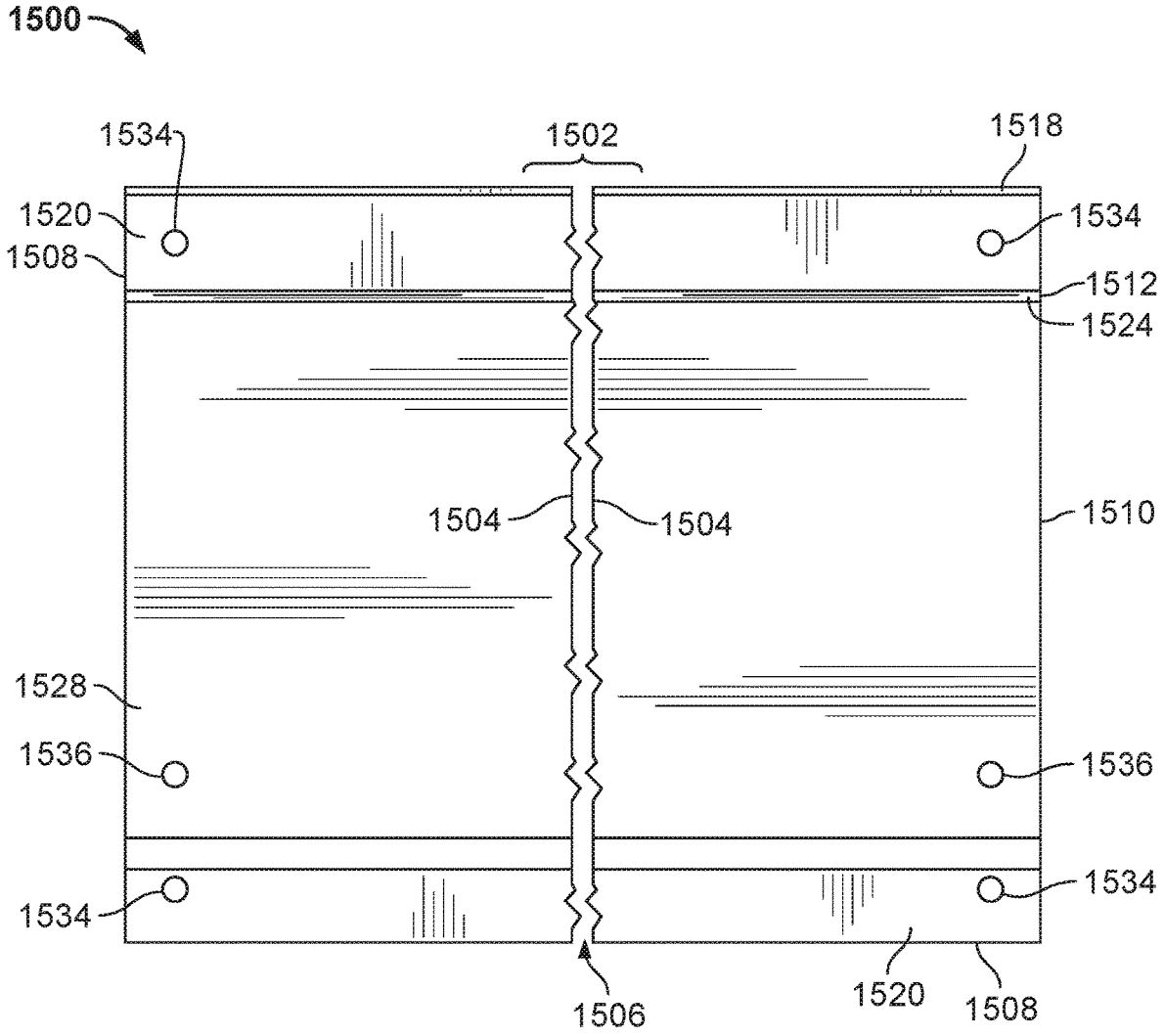
FIG. 16 shows a front side of the ledger shown in FIG. 15.
Figure 17:
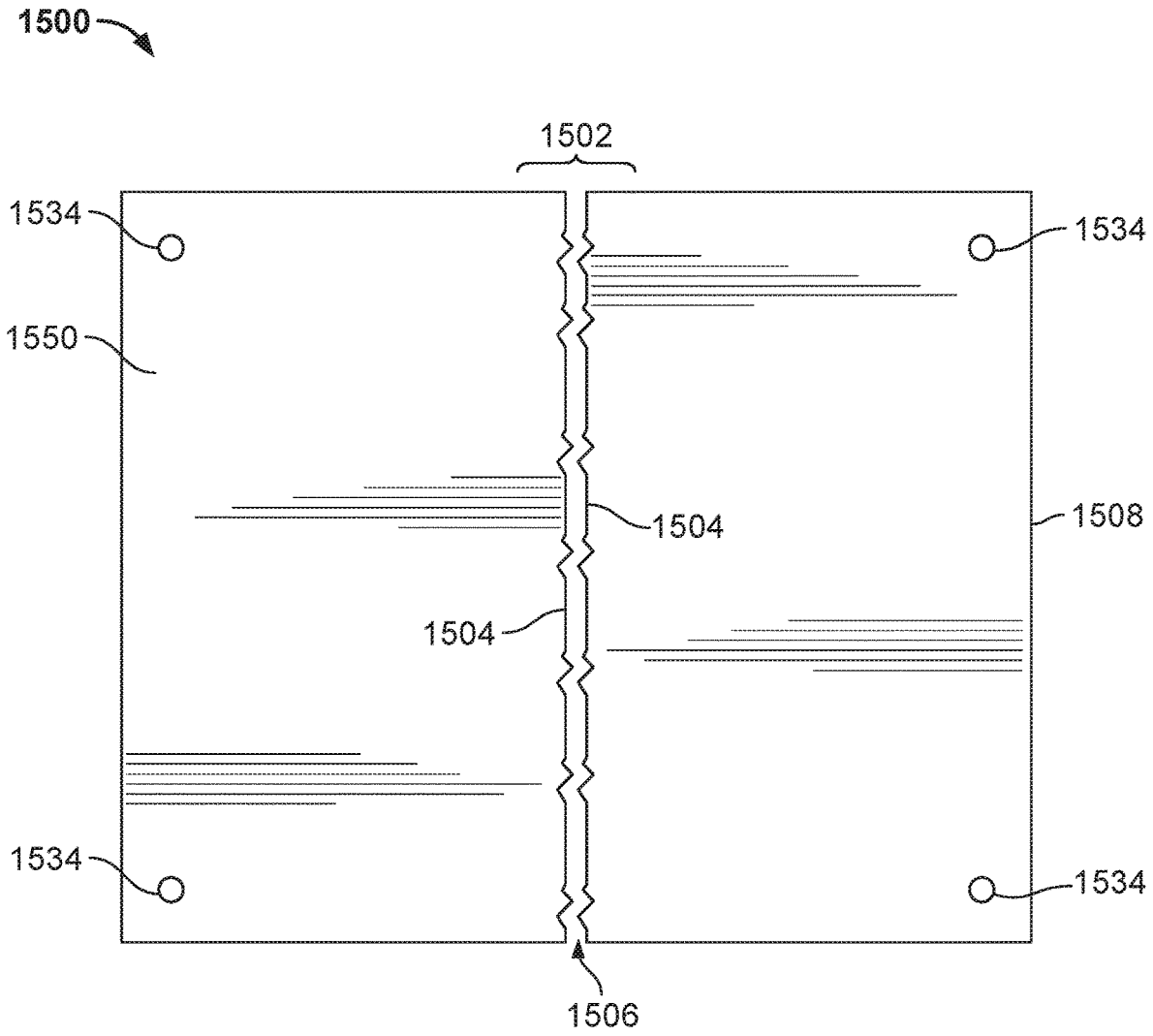
FIG. 17 shows a back side of the ledger shown in FIG. 15.
Figure 18:
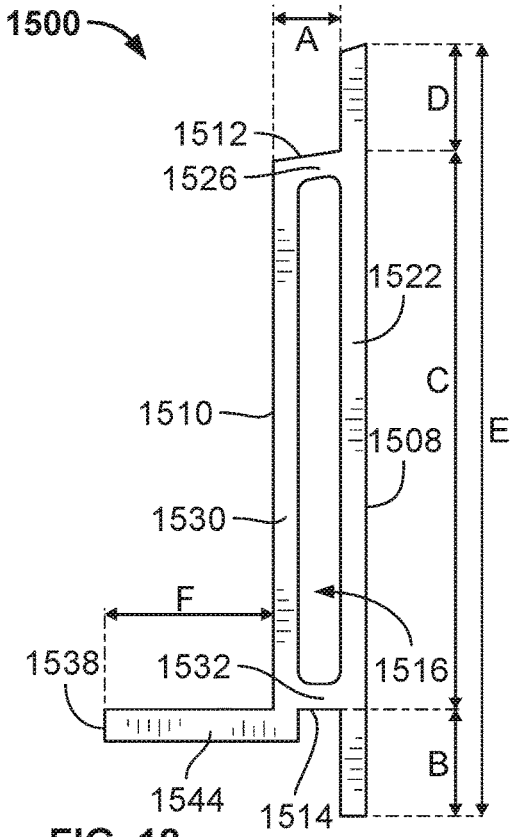
FIG. 18 shows a right side of the ledger shown in FIG. 15.
Figure 19:
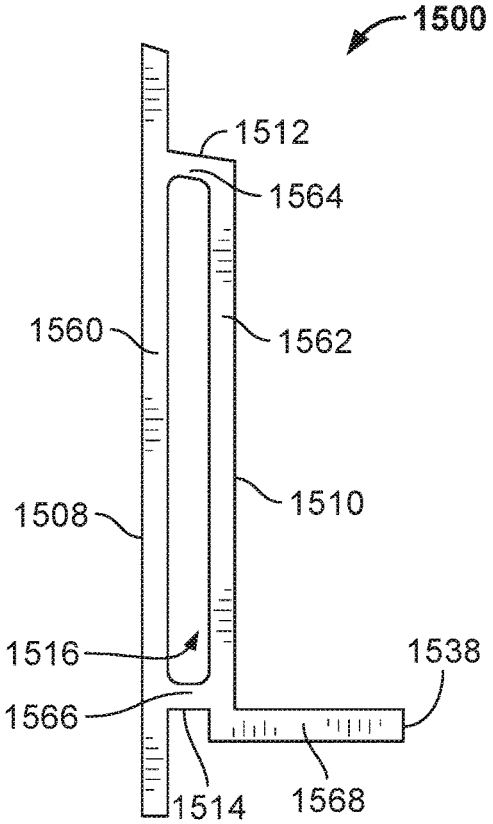
FIG. 19 shows a left side of the ledger shown in FIG. 15.
Figure 20:
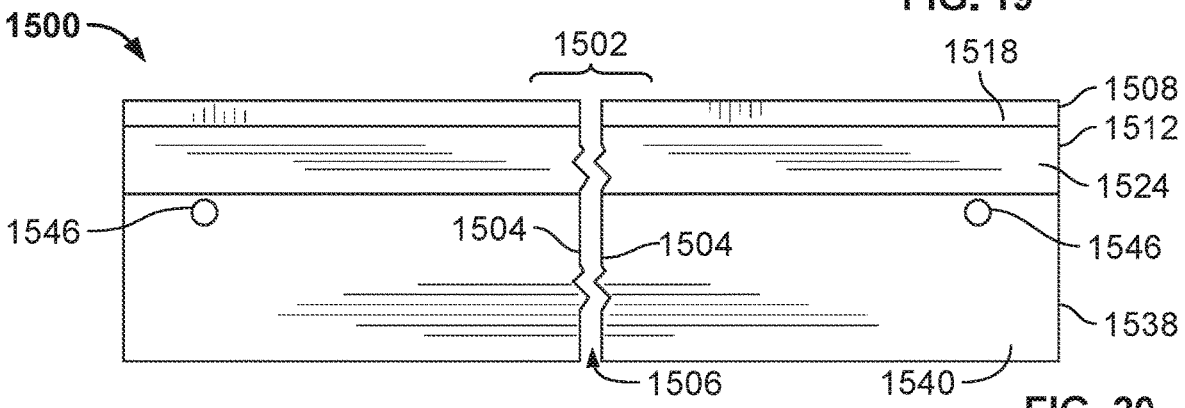
FIG. 20 shows a top side of the ledger shown in FIG. 15.
Figure 21:
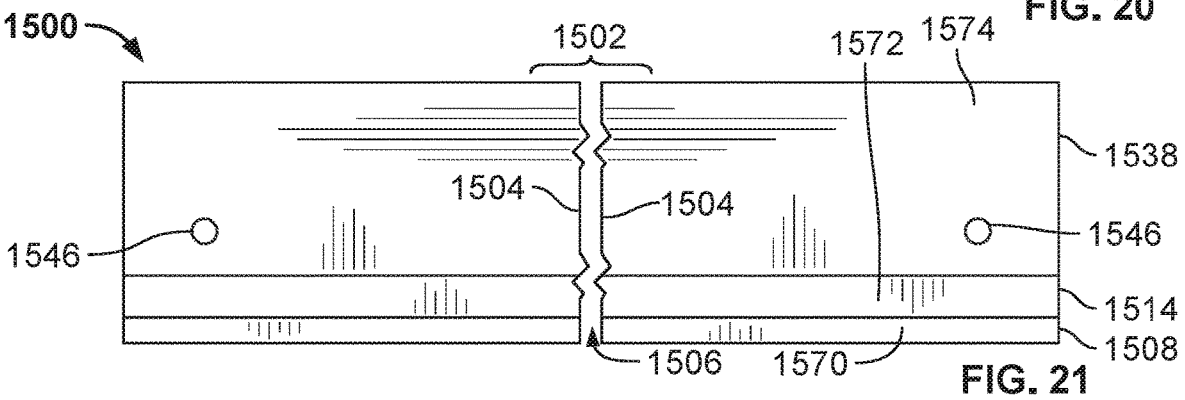
FIG. 21 shows a bottom side of the ledger shown in FIG. 15.

Next, FIG. 15 is a perspective view of a ledger 1500 in accordance with additional example implementations. For this description, this perspective view is said to show a top side of the ledger 1500, a portion of a front side of the ledger 1500, and a right side of the ledger 1500. Although not shown in FIG. 15, the ledger 1500 has (a) a bottom side opposite the top side, (b) a back side opposite the front side, and (c) a left side opposite the right side. FIG. 16 shows the front side of the ledger 1500. FIG. 17 shows the back side of the ledger 1500. FIG. 18 shows the right view of the ledger 1500. FIG. 19 shows the left side of the ledger 1500. FIG. 20 shows the top side of the ledger 1500. FIG. 21 shows the bottom side of the ledger 1500.

FIG. 15 to FIG. 17, FIG. 20, and FIG. 21 show a bracket 1502, jagged lines 1504, and a gap 1506 to represent that the ledger 1500 has an indeterminate length. In some example implementations, the ledger 1500 can be made with a length of eight feet, twelve feet, sixteen feet, or twenty feet. In other implementations, the ledger 1500 can have a different length.

The ledger 1500 includes walls 1508, 1510 and ledges 1512, 1514, 1538. The ledge 1512 joins the walls 1508, 1510. Likewise, the ledge 1514 also joins the walls 1508, 1510. The ledge 1538 extends away from the wall 1510. The walls 1508, 1510 and ledges 1512, 1514 form a channel 1516. The channel 1516 separates the walls 1508, 1510. The channel 1516 also separates the ledges 1512, 1514. In some implementations, the channel 1516 extends from the right side of the ledger 1500 to the left side of the ledger 1500.

FIG. 15 shows that (a) the wall 1508 includes a top surface 1518, a front surface 1520, and a right side surface 1522, (b) the ledge 1512 includes a top surface 1524 and a right side surface 1526, (c) the wall 1510 includes a front surface 1528 and a right side surface 1530, (d) ledge 1514 includes a right side surface 1532, and (e) the ledge 1538 includes a top surface 1540, a front surface 1542, and a right side surface 1544. FIG. 15 shows anchor holes 1534 in the wall 1508, weep holes 1536 in the wall 1510, and weep holes 1546 in the ledge 1538.

Next, in addition to showing the front side of the ledger 1500, FIG. 16 shows the wall 1510, the front surface 1528, portions of the wall 1508, portions of the front surface 1520, the ledge 1512, the top surfaces 1518, 1524, the anchor holes 1534, and the weep holes 1536. In the implementation shown in FIG. 16, the top surfaces 1518, 1524 are beveled so that water on the top surface 1518, 1524 flows in a direction from the back side of the ledger 1500 towards the front side of the ledger 1500. In the implementations in which the ledger 1500 is attached to a wall of a structure, the beveled top surfaces 1518, 1524 keep water on the top surfaces from flowing towards the wall of that structure. As an example, the top surface 1518 can be beveled such that top surface 1518 at the front side of the wall 1508 is 0.125 inches lower than the top surface 1518 at the back side of the wall 1508. Likewise, the top surface 1524 can be beveled downward by 0.125 inches. The top surfaces 1518, 1524 can, but need not necessarily, be beveled by the same distance or slope.

Next, in addition to showing the back side of the ledger 1500, FIG. 17 shows the wall 1508, a back surface 1550 of the wall 1508, and the anchor holes 1534.

Next, in addition to showing the right side of the ledger 1500, FIG. 18 shows the walls 1508, 1510, the ledges 1512, 1514, 1538, the channel 1516, and the right side surfaces 1522, 1526, 1530, 1532, 1544. A right side surface of the ledger 1500 comprises the right side surfaces 1522, 1526, 1530, 1532, 1544. Furthermore, FIG. 18 shows dimensions A, B, C, D, and E. Those dimensions can have lengths as described for dimensions A, B, C, D, and E, respectively, shown in FIG. 4. In some implementations, the walls 1508, 1510 and the ledges 1512, 1514, 1538 can be 0.125 inches thick, and the channel 1516 can have the same width as the channel 116.

Next, in addition to showing the left side of the ledger 1500, FIG. 19 shows the walls 1508, 1510, the ledges 1512, 1514, 1538, the channel 1516, a left side surface 1560 of the wall 1508, a left side surface 1562 of the wall 1510, a left side surface 1564 of the ledge 1512, a left side surface 1566 of the ledge 1514, and a left side surface 1568 of the ledge 1538. A left side surface of the ledger 1500 comprises the left side surfaces 1560, 1562, 1564, 1566, 1568.

Next, in addition to showing the top side of the ledger 1500, FIG. 20 shows the wall 1508, the ledges 1512, 1538, and the top surfaces 1518, 1524, 1540, and weep holes 1546 in the ledge 1538.

Next, in addition to showing the bottom side of the ledger 1500, FIG. 21 shows the wall 1508, the ledges 1514, 1538 a bottom surface 1570 of the wall 1508, a bottom surface 1572 of the ledge 1514, a bottom surface 1574 of the ledge 1538, and the weep holes 1546.

The ledger 1500 can have a fixed cross-sectional profile prior to any machining of the ledger 1500. The machining can, for example, include drilling or punching holes, such as the anchor holes 1534, the weep holes 1536, and/or the weep holes 1546.

III. Ledger Attachment

Figure 22:
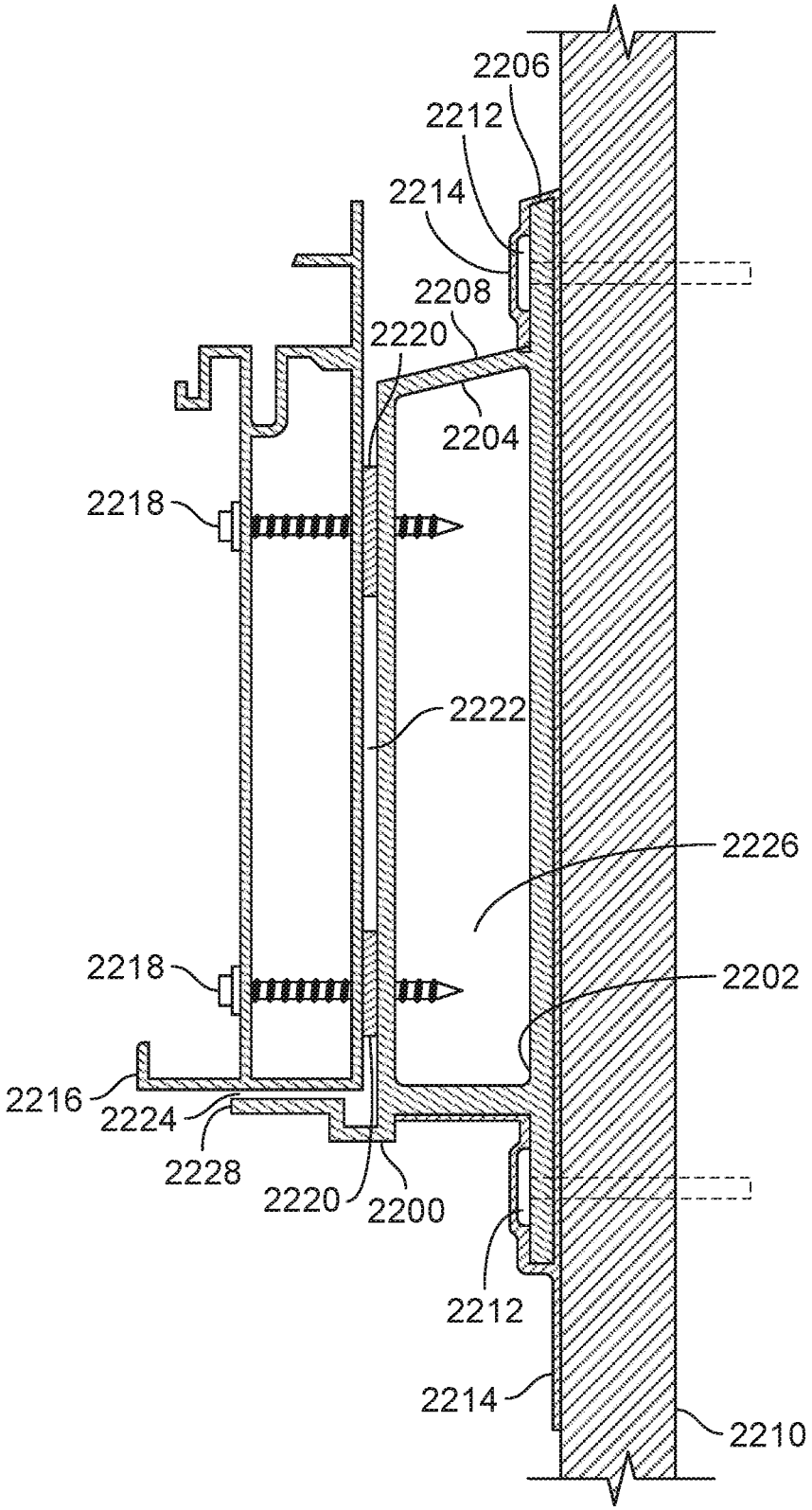
FIG. 22 is a cross-sectional view of a ledger attached to a wall in accordance with example implementations.

Next, FIG. 22 is a cross-sectional view of a ledger 2200 attached to a wall 2210 in accordance with some example implementations. The ledger 2200 is configured like the ledger 100 shown in FIG. 1 to FIG. 7. The ledger 2200 includes multiple walls, multiple ledgers, multiple anchor holes, multiple weep holes, and a channel 2226. In FIG. 22, one of the walls including anchor holes is identified as a wall 2202, and one of the ledges is identified as a ledge 2204 and another ledge is identified as a ledge 2228. The wall 2202 corresponds to the wall 108 shown in FIG. 1. The ledge 2204 corresponds to the ledge 112 shown in FIG. 1. A top surface of the wall 2202 is identified as a top surface 2206 and a top surface of the ledge 2204 is identified as a top surface 2208.

The ledger 2200 is attached to a wall 2210 of a structure, such as a house or building. As an example, the wall 2210 can be made of a material, such as wood or concrete. Fasteners 2212, such as anchor bolts or lag screws, can be disposed within anchor holes in the wall 2202 and within the wall 2210 to keep the ledger 2200 attached to the wall 2210.

The top surfaces 2206, 2208 can be beveled downward as those top surfaces extend away from the wall 2210. The beveled top surfaces can cause water on the top surfaces 2206, 2208 to flow away from the wall 2210 to reduce the chance of the water penetrating the wall 2210.

In some implementations, a barrier material 2214, such as an air and/or vapor barrier, can be disposed on in proximity to the ledger 2200 and/or the wall 2210. For example, the barrier material 2214 can cover the top surface 2206 and the fasteners 2212. The barrier material 2214 can extend above the fasteners 2212, below the fasteners, to the left of the fasteners 2212, and/or to the right of the fasteners. The barrier material 2214 can extend above and/or below the wall 2202. As an example, the barrier material 2214 can comprise a rubberized asphalt adhesive, such as TITE SEAL™ All Purpose Flashing, part number TSAP950, sold by Cofair Products, Inc., Skokie, Ill. Other examples of the barrier material 2214 are also possible.

In some implementations, a metallic deck frame segment 2216 can be attached to the ledger 2200. As an example, the metallic deck frame segment 2216 can be arranged like a box-frame component discussed in United States Patent Application Publication No. 2015/0152630, which is incorporated herein by reference. The metallic deck frame segment 2216 can attach to and/or at least partially support other components of a deck, such as joists and/or deck boards.

Fasteners 2218, such as self-tapping screws, can be used to attach the metallic deck frame segment 2216 to the ledger 2200. As shown in FIG. 22, the fasteners 2218 are partially disposed within the metallic deck frame segment 2216, but do not penetrate the wall 2210. Accordingly, water cannot penetrate the wall 2210 at holes through which the fasteners 2218 are disposed.

Shims 2220 can be disposed between the ledger 2200 and the metallic deck frame segment 2216. The shims 2220 can provide a gap 2222 between the ledger 2200 and the metallic deck frame segment 2216. In this way, water flowing off the top surface 2208 can flow through the gap 2222 to reach a weep hole in the ledger 2200. Moreover, water within the channel 2226 can flow through a weep hole in a wall and/or a weep hole in a ledge of ledger 2200. The shims 2220 can include or be configured like a steel washer, for example a steel disk with a through-hole in the center of the disk.

As shown in FIG. 22, the metallic deck frame segment 2216 may not directly contact the ledger 2200 due to the shims 2220 providing for the gap 2222, as well as a gap 2224 resulting from the metallic deck frame segment 2216 being attached above the ledge 2228. In other implementations, the metallic deck frame segment 2216 can directly contact the ledger 2200. For example, the ledger 2200 can directly contact the ledge 2228.

In other implementations, the ledger 2200 can be configured like the ledger 800 shown in FIG. 8 to FIG. 14 such that the wall 2202 corresponds to the wall 808 shown in FIG. 8 and the ledge 2204 corresponds to the ledge 812 shown in FIG. 8. In other words, the ledger 800 can be attached to the wall 2210 similar to how the ledger 2200 is attached to the wall 2210, and the metallic deck frame segment 2216 can attach to the ledger 800 similar to how the metallic deck frame segment 2216 is attached to the ledger 2200.

In other implementations, the ledger 2200 can be configured like the ledger 1500 shown in FIG. 15 to FIG. 21 such that the wall 2202 corresponds to the wall 1508 shown in FIG. 15 and the ledge 2204 corresponds to the ledge 1512 shown in FIG. 15. In other words, the ledger 1500 can be attached to the wall 2210 similar to how the ledger 2200 is attached to the wall 2210, and the metallic deck frame segment 2216 can attach to the ledger 1500 similar to how the metallic deck frame segment 2216 is attached to the ledger 2200.

In still other implementations of the ledger 2200 attached to the wall 2210, instead of attaching the metallic deck frame segment 2216 to the ledger 2200, multiple joist hangers can be attached to the ledger 2200. Similar to the metallic deck frame segment 2216, the joist hangers can be attached to the ledger 2200 using the fasteners 2218 that do not penetrate the wall 2210. As an example, a joist hanger can be a hanger having part number HU214 from the Simpson Strong-Tie Company Inc., Pleasanton, Calif. That particular joist hanger has twelve attachment holes through which the fasteners 2218 can be disposed. Joists of a deck can be supported by the joist hangers attached to the ledger 2200.

Figure 23:
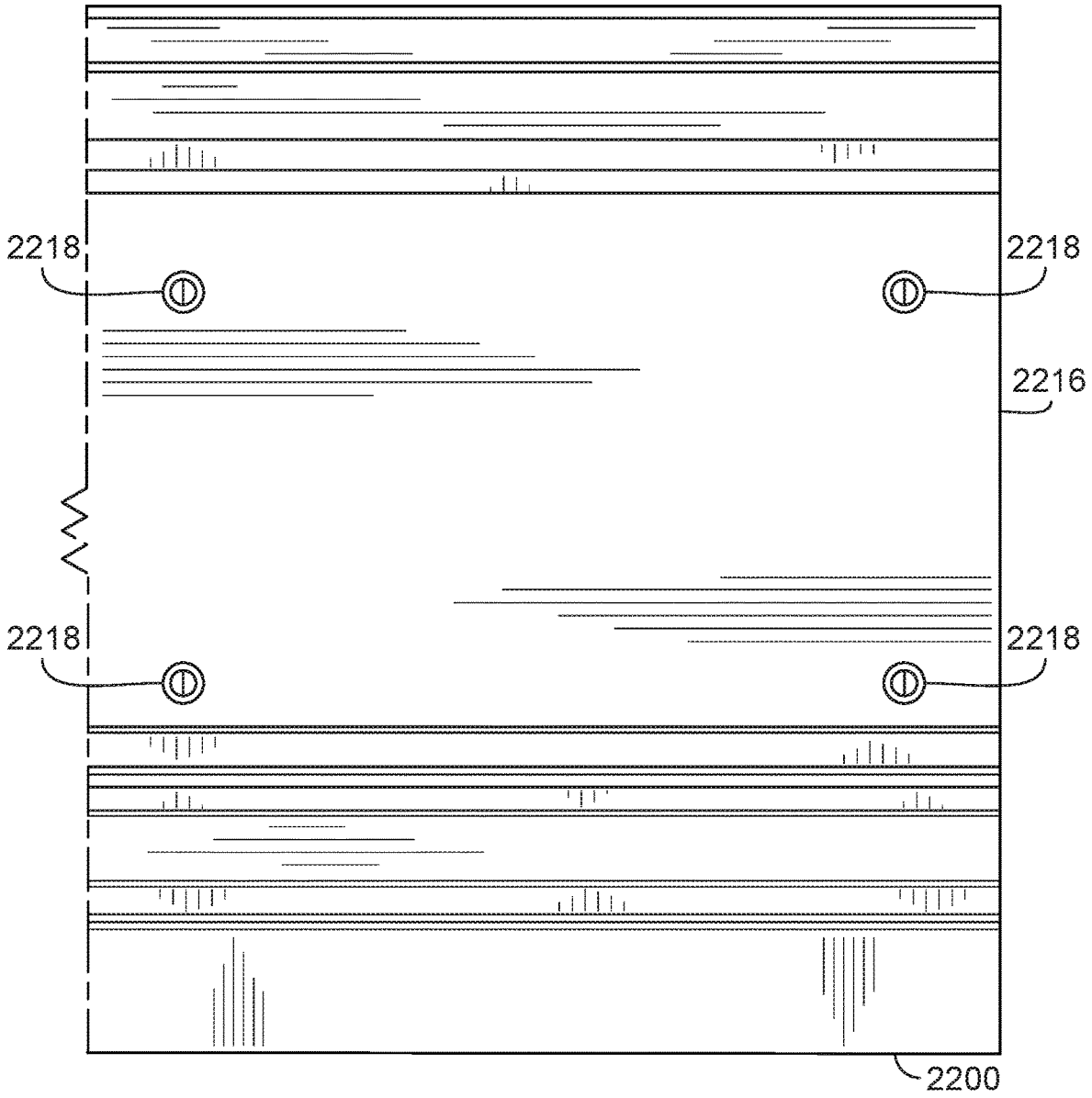
FIG. 23 is an elevation view of a portion of the ledger shown in FIG. 22 in accordance with example implementations.

Next, FIG. 23 is an elevation view of a portion of the ledger 2200. FIG. 23 also shows the metallic deck frame segment 2216 attached to the ledger 2200 using the fasteners 2218. FIG. 23 includes a broken line to represent that the left sides of the ledger 2200 and the metallic deck frame segment 2216 can extend to the left for an indeterminate length. For clarity of the figure, FIG. 23 does not show the wall 2210 or the barrier material 2214.

Figure 24:
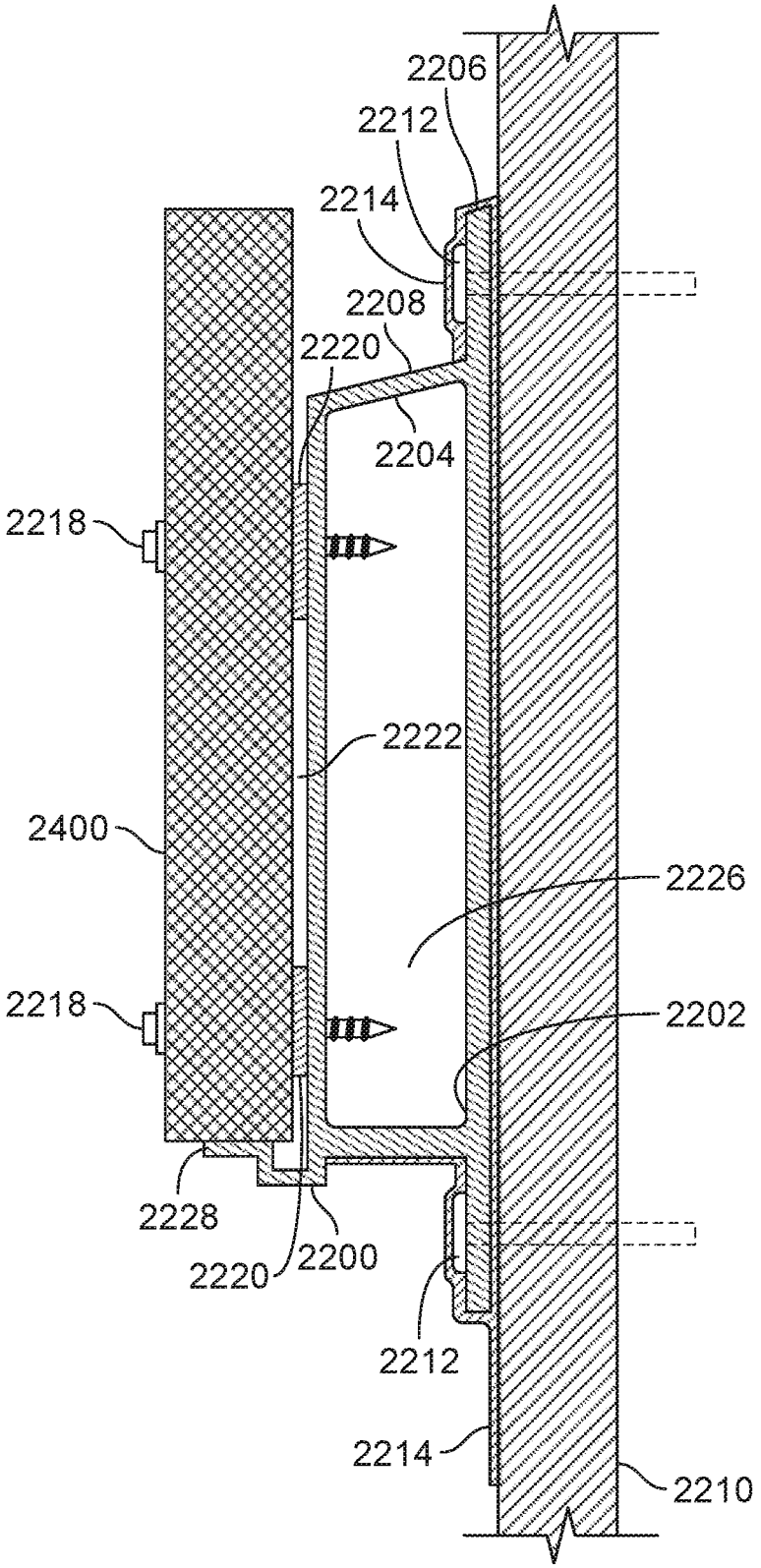
FIG. 24 is another cross-sectional view of a ledger attached to a wall in accordance with example implementations

Next, FIG. 24 is another cross-sectional view of the ledger 2200 attached to the wall 2210. This view varies from the view shown in FIG. 22 because a ledger board 2400 is attached to the ledger 2200 instead of the metallic deck frame segment 2216. Furthermore, FIG. 24 shows that the ledger board 2400 directly contacts the ledger 2200 as the ledger board 2400 directly contacts the ledge 2228. The ledger board 2400 can be attached to the ledger 2200 using the fasteners 2218. As an example, the ledger board 2400 can include a two by eight, a two by ten, or a two by twelve pressure-treated Spruce, Pine or Fir wooden board.

Next, FIG. 25 illustrates a ledger attached to a wall of a structure in accordance with example implementations. In particular, FIG. 25 shows the ledger 100 attached to the wall 2210 using fasteners 2500. The fasteners 2500 are disposed in the anchor holes 150 (which are covered by a head of the fasteners 2500). As an example, the fasteners 2500 can include anchor bolts or lag screws. For clarity of the figure, FIG. 25 does not show a barrier material that may be installed during attachment of the ledger 100 to the wall 2210.

FIG. 25 shows that the ledger 100 has a length 2502 and a horizontal spacing between anchor bolts has a distance 2504. A horizontal spacing between the anchor holes 150 can be identical to the distance 2504. The length 2502 can be based on a length of a deck to be constructed. As an example, the length 2502 can be eight feet, twelve feet, sixteen feet, or twenty feet. The distance 2504 can depend on various factors, such as a size of fasteners to be disposed within the anchor holes and the forces to be applied by components to be attached to the ledger 100, such as the metallic deck frame segment 2216, the ledger board 2400, or joist hangers. As an example, the distance 2504 can be twelve inches, sixteen inches or a number of inches between twelve and sixteen inches. Other examples of the length 2502 and/or the distance 2504 are also possible. The weep holes 152 can be spaced apart horizontally by the distance 2504 or some other distance. One or more of the weep holes 152 can be aligned vertically with an anchor hole 150 or can be vertically offset from each of the anchor holes.

The ledgers described in this description can be scored to indicate possible machining locations. For example, in FIG. 25, the ledger 100 is shown to have a scored line 2506 to represent possible locations of drilling holes for placement of fasteners to attach a component to the ledger 100, such as metallic deck frame segment 2216 or the ledger board 2400.

IV. Conclusion

It should be understood that the arrangements described herein and/or shown in the drawings are for purposes of example only. As such, those skilled in the art will appreciate that other arrangements and elements can be used instead, and some elements can be omitted altogether according to the desired results.

While various implementations are described herein, other implementations will be apparent to those skilled in the art. The various implementations disclosed herein are for purposes of illustration and are not intended to be limiting, with the true scope being indicated by the claims, along with the full scope of equivalents to which such claims are entitled. It is also to be understood that the terminology used herein for the purpose of describing particular implementations only, and is not intended to be limiting.

In this description, the articles "a," "an," and "the" are used to introduce elements of the example implementations. The intent of using those articles is that there is one or more of the introduced elements.

In this description, the intent of using the term "and/or" within a list of at least two elements and the intent of using the terms "at least one of" and "one or more of" immediately preceding a list of at least two elements is to cover each embodiment including a listed component independently and each embodiment comprising a combination of the listed components. For example, an embodiment described as comprising "A, B, and/or C," or "at least one of A, B, and C," or "one or more of A, B, and C" is intended to cover each of the following possible embodiments: (i) an embodiment comprising A, but not B and not C, (ii) an embodiment comprising B, but not A and not C, (iii) an embodiment comprising C, but not A and not B, (iv) an embodiment comprising A and B, but not C, (v) an embodiment comprising A and C, but not B, (v) an embodiment comprising B and C, but not A, and (vi) an embodiment comprising A, B, and C. For the embodiments comprising component A, the embodiments can comprise one A or multiple A. For the embodiments comprising component B, the embodiments can comprise one B or multiple B. For the embodiments comprising component C, the embodiments can comprise one C or multiple C. The use of ordinal numbers such as "first," "second," "third" and so on is to distinguish respective elements rather than to denote a particular order of those elements unless the context of using those terms explicitly indicates otherwise.

What is claimed is:

1. A ledger configured for attaching to a structure, the ledger comprising:

a first wall;

a second wall;

a first ledge joining the first wall and the second wall;

a second ledge joining the first wall and the second wall, wherein the first wall, the second wall, the first ledge, and the second ledge define a channel that (i) separates the first wall from the second wall, and (ii) separates the first ledge from the second ledge, wherein the channel is open at both a first side of the ledger, and a second side of the ledger opposite the first side of the ledger, wherein the first ledge is disposed above the second ledge, wherein a portion of the first wall is disposed above the first ledge, wherein a portion of the first wall is disposed below the second ledge, and wherein both the portion of the first wall and a portion of the second wall include at least one through-hole.

2. The ledger of claim 1, wherein the first wall includes a front surface, a back surface, and a top surface joining the front surface and the back surface.

3. The ledger of claim 2, wherein the top surface is beveled downward from the back surface to the front surface.

4. The ledger of claim 2, wherein the first ledge is beveled downward from the first wall to the second wall.

5. The ledger of claim 2, wherein a portion of the first wall including the top surface is disposed above both the first ledge and the second ledge.

6. The ledger of claim 5, wherein the portion of the first wall including the top surface includes at least one through-hole.

7. The ledger of claim 2, wherein the first wall includes (i) a bottom surface opposite the top surface, and (ii) a portion, including the bottom surface, disposed below both the first ledge and the second ledge.

8. The ledger of claim 7, wherein the portion, including the bottom surface, disposed below both the first ledge and the second ledge includes at least one through-hole.

9. The ledger of claim 1, further comprising:
a third ledge,
wherein the first ledge and the second ledge join the second wall on a first side of the second wall,
wherein the third ledge is disposed on a second side of the second wall, and
wherein the second side of the second wall is opposite the first side of the second wall.

10. The ledger of claim 9, wherein the third ledge joins the second wall.

11. The ledger of claim 9, further comprising:
a fourth ledge joining the second wall on the second side of the second wall; and
a third wall that joins both the third ledge and the fourth ledge, wherein the fourth ledge is below the first ledge, the second ledge, and the third ledge.

12. The ledger of claim 11, wherein the fourth ledge includes at least one through-hole configured to drain a fluid on a top side of the fourth ledge.

13. The ledger of claim 11,
wherein the third ledge is configured to support a deck frame segment,
wherein the second wall includes multiple through-holes,
wherein the ledger is configured for fixedly attaching to the deck frame segment by fasteners placed within the multiple through-holes in the second wall, and
wherein the fasteners do not pass through the first wall.

14. The ledger of claim 13, wherein multiple shims are placed between the ledger and the deck frame segment.

15. The ledger of claim 1, wherein the ledger is a single extrusion.

16. The ledger of claim 1, wherein the ledger is made of aluminum.

17. The ledger of claim 1, wherein the ledger is made by extruding aluminum through a die.

18. The ledger of claim 1,
wherein the first ledge and the second ledge join the second wall on a first side of the second wall,
wherein a second side of the second wall is (i) opposite the first side of the second wall, and (ii) scored, proximate the second ledge, at least partially from the first side of the ledger to the second side of the ledger.

19. The ledger of claim 1,
wherein the first wall includes a first row of anchor holes and a second row of anchor holes, and
wherein at least some anchor holes of the first row of anchor holes and at least some anchor holes in the second row of anchor holes are squarely aligned with each other.

20. The ledger of claim 1,
wherein the first wall includes a first row of anchor holes and a second row of anchor holes, and
wherein at least one anchor hole in the first row of anchor holes closest to a respective anchor hole in the second row of anchor holes are staggered.

21. A ledger configured for attaching to a structure, the ledger comprising:
a first wall;
a second wall;
a first ledge joining the first wall and the second wall;
a second ledge joining the first wall and the second wall; and
a third ledge;
wherein the first ledge and the second ledge join the second wall on a first side of the second wall,
wherein the third ledge joins the second wall on a second side of the second wall,
wherein the second side of the second wall is opposite the first side of the second wall,
wherein the first wall, the second wall, the first ledge, and the second ledge define a channel that (i) separates the first wall from the second wall, and (ii) separates the first ledge from the second ledge,
wherein the channel is open at both a first side of the ledger, and a second side of the ledger opposite the first side of the ledger,
wherein the first ledge is disposed above the second ledge,
wherein a portion of the first wall is disposed above the first ledge,
wherein a portion of the first wall is disposed below the second ledge, and
wherein both the portion of the first wall and a portion of the second wall include at least one through-hole.

22. A ledger configured for attaching to a structure, the ledger comprising:
a first wall;
a second wall;
a third wall;
a first ledge joining the first wall and the second wall;
a second ledge joining the first wall and the second wall; and
a third ledge; and
a fourth ledge joining the second wall;
wherein the first ledge and the second ledge join the second wall on a first side of the second wall,
wherein the fourth ledge joins the second wall on a second side of the second wall,
wherein the third wall joins both the third ledge and the fourth ledge,
wherein the second side of the second wall is opposite the first side of the second wall,
wherein the fourth ledge is below the first ledge, the second ledge, and the third ledge,
wherein the first wall, the second wall, the first ledge, and the second ledge define a channel that (i) separates the first wall from the second wall, and (ii) separates the first ledge from the second ledge, and
wherein the channel is open at both a first side of the ledger, and a second side of the ledger opposite the first side of the ledger,
wherein the first ledge is disposed above the second ledge,
wherein a portion of the first wall is disposed above the first ledge,
wherein a portion of the first wall is disposed below the second ledge, and wherein both the portion of the first wall and a portion of the second wall include at least one through-hole.

* * * * *